US009057592B2

(12) United States Patent
Rastegar

(10) Patent No.: US 9,057,592 B2
(45) Date of Patent: Jun. 16, 2015

(54) MULTI-STAGE MECHANISMS FOR EVENT DETECTION AND INITIATION OF PYROTECHNIC MATERIALS IN THERMAL BATTERIES AND THE LIKE IN MUNITIONS

(71) Applicant: Jahangir S Rastegar, Stony Brook, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 122 days.

(21) Appl. No.: 13/867,824

(22) Filed: Apr. 22, 2013

(65) Prior Publication Data

US 2013/0276657 A1 Oct. 24, 2013

Related U.S. Application Data

(60) Provisional application No. 61/637,817, filed on Apr. 24, 2012.

(51) Int. Cl.

| | |
|---|---|
| ***F42C 15/24*** | (2006.01) |
| ***F42C 15/00*** | (2006.01) |
| ***F42C 15/40*** | (2006.01) |

(52) U.S. Cl.

CPC ..... *F42C 15/24* (2013.01); *F42C 15/005* (2013.01); *F42C 15/40* (2013.01)

(58) Field of Classification Search

CPC ..... F41C 19/06; F41C 15/24; F41C 15/40; F41C 15/184; F41C 15/00

USPC ..... 102/216, 215, 206, 247

See application file for complete search history.

(56) References Cited

U.S. PATENT DOCUMENTS

| | | | | |
|---|---|---|---|---|
| 4,949,639 | A * | 8/1990 | Burns | 102/249 |
| 6,167,809 | B1 * | 1/2001 | Robinson et al. | 102/235 |
| 2008/0041263 | A1 * | 2/2008 | Rastegar et al. | 102/272 |
| 2010/0132577 | A1 * | 6/2010 | Rastegar | 102/247 |
| 2011/0171511 | A1 * | 7/2011 | Rastegar et al. | 429/112 |
| 2012/0205225 | A1 * | 8/2012 | Rastegar et al. | 200/61.45 R |
| 2013/0284044 | A1 * | 10/2013 | Rastegar et al. | 102/216 |

* cited by examiner

*Primary Examiner* — Bret Hayes
*Assistant Examiner* — Joshua Freeman

(57) ABSTRACT

A method for detecting a number of events having an acceleration profile greater than a predetermined threshold. The method including: detecting a number of events having the acceleration profile greater than the predetermined threshold; counting the number of events detected having the acceleration profile greater than the predetermined threshold; and outputting a mechanical or electrical signal based on whether the counted number of events having the acceleration profile greater than the predetermined threshold is greater than a predetermined number.

9 Claims, 14 Drawing Sheets

MULTI-STAGE MECHANISMS FOR EVENT DETECTION AND INITIATION OF PYROTECHNIC MATERIALS IN THERMAL BATTERIES AND THE LIKE IN MUNITIONS

CROSS REFERENCE TO RELATED APPLICATION

This application claims the benefit of earlier filed U.S. Provisional Application No. 61/637,817, filed on Apr. 24, 2012, the entire contents of which is incorporated herein by reference.

BACKGROUND OF THE INVENTION

1. Field of the Invention

The present invention relates generally to multi-stage mechanical mechanisms for the initiation of pyrotechnic materials in thermal batteries or the like devices requiring pyrotechnic initiation in munitions, and more particularly for initiation of such pyrotechnic materials in munitions following a predetermined number of deceleration events such as the so-called set-forward acceleration in gun-fired munitions and mortars or target impact events. The means of the said activation may be mechanical by causing certain relevant motion in the system/device to be produced or electrical by causing a circuit to be closed or opened and/or electrical pulses to be generated or cause other detectable events that indicate the impact event and/or the severity of the impact.

2. Prior Art

Thermal batteries represent a class of reserve batteries that operate at high temperatures. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In an activated thermal battery, since the electrolyte is in its molten state, the battery cannot withstand high-G shocks that are caused as the munitions impacts a hard surface such as the intended target. For this reason, when the thermal battery is intended to be used to power certain devices following target impact, then it is highly desirable for the thermal battery to be activated following such shock loadings. In certain applications, the munitions is intended to enter the interior of a building or a bunker through more than a single wall, ceiling, floor or otherwise significant barrier (hereinafter, all such significant barriers are referred to collectively as "significant barriers", with the aim of including those obstacles that cause shock loading of the munitions above certain predetermined level and excluding minor obstacles that are not used for protection against incoming munitions). In such applications, it is highly desirable for the thermal battery to be initiated following a prescribed number of shock loadings (impacts), each corresponding to shock loading due to impact with a significant barrier.

It is appreciated by those skilled in the art that an initiation device that is used to ignited pyrotechnic materials in thermal batteries may also be used to initiate pyrotechnics materials in other devices or initiate explosive charges.

SUMMARY OF THE INVENTION

A need therefore exists for the development of novel methods and mechanical inertia-based mechanisms for initiation of thermal batteries and other similar devices used in gun fired munitions, mortars, rockets, gravity dropped weapons and other types of munitions after the said munitions has impacted a prescribed number of "significant barriers".

A need also exists for the development of novel methods and mechanical inertia-based mechanisms for initiation of thermal batteries and other similar devices used in gun fired munitions, mortars, rockets, gravity dropped weapons and other types of munitions after the said munitions has impacted a prescribed number of "significant barriers" or has failed to encounter the prescribed number of "significant barriers" after a prescribed amount of time has elapsed.

It is noted that in gun-fired munitions and mortars the direction of the setback acceleration is opposite to the direction of the "significant barrier" impact induced acceleration. Therefore the said novel mechanical inertia-based mechanisms for initiation of thermal batteries and other similar devices in such munitions must be capable of withstanding firing setback acceleration and not initiate.

It is also noted that in gun-fired munitions and mortars the direction of the set forward acceleration experienced by the munitions is in the same direction as the direction of the "significant barrier" impact induced acceleration. Therefore for the said novel mechanical inertia-based mechanisms for initiation of thermal batteries and other similar devices to correctly detect the number of encountered "significant barriers", it must be capable of differentiating the set forward acceleration from the "significant barrier" impact induced acceleration. This task is generally not difficult to accomplish as described later in this disclosure, since the set forward acceleration level is usually much lower than the level of "significant barrier" impact induced acceleration.

A need therefore also exists for novel mechanical inertia-based mechanisms for initiation of thermal batteries and other similar devices to be used in gun-fired munitions and mortars and the like to be able to differentiate the set forward acceleration from the "significant barrier" impact induced acceleration.

In certain applications, the said novel mechanical inertia-based mechanisms for (mechanical or electrical) initiation of thermal batteries and other similar devices are desired to in addition of detecting ("counting") the number of encountered "significant barriers", to also determine the corresponding level of each encountered impact force. The level of encountered impact force is usually desirable for the purpose of determining the strength of the encountered significant barrier. In addition, in certain cases it is desired to also know the time history (i.e., the profile) of the encountered impact force, since such a profile give an indication of the strength, type and thickness of the encountered "significant barrier".

A need therefore also exists for novel mechanical inertia-based mechanisms for (mechanical or electrical) initiation of thermal batteries and other similar devices to detect the number of encountered "significant barriers" as well as their resulting impact force levels.

A need therefore also exists for novel mechanical inertia-based mechanisms for (mechanical or electrical) initiation of thermal batteries and other similar devices to detect the number of encountered "significant barriers" as well as the time history (time profile) of their resulting impact force levels.

In addition, new improved chemistries, manufacturing processes and packaging technologies have been developed in recent years that promise the development of lower cost and higher performance thermal batteries that could be produced in various shapes and sizes, including their small and miniaturized versions. It is, therefore, highly desirable for the developed mechanical inertial-based initiation devices to be small for such small and low power thermal batteries, particularly those that are being developed for use in miniaturized fuzing, future smart munitions, and other similar applications.

The innovative inertia based initiation devices would preferably be scalable to thermal batteries and other similar devices of various sizes, in particular to miniaturized initiation devices for small size thermal batteries.

Such inertia based initiation devices must in general be safe and in particular they should not initiate if dropped, e.g., from up to 7 feet onto a concrete floor for certain applications; should withstand high firing accelerations, for example up to and in certain cases over 20-50,000 Gs; and should be able to be designed to initiate after a predetermined number of "significant barriers" have been encountered. To ensure safety and reliability, inertial igniters should not initiate during acceleration events which may occur during manufacture, assembly, handling, transport, accidental drops, or other similar accidental events. In addition, such inertia based devices must be capable of differentiating the aforementioned accidental events such as dropping from up to 7 feet or accelerations and decelerations during transportation from shock loading experienced as a result of impact with a "significant barrier", i.e., the device should not be activated to count such accidental events as "significant barrier" impacts.

In certain applications, the pyrotechnic materials in thermal batteries or the like are required to be initiated by electrical initiation elements. In such applications, electrical energy is preferably generated by piezoelectric elements during one or more of encountered high G events such as firing setback or set forward accelerations or impact shock when encountering "significant batteries" or during the munitions fight as a result of vibration and/or oscillatory motions. In such applications, the available electrical power may be used to power appropriate electronics and logics circuitry such that the number of encountered "significant barriers" could be counted and initiation command provided once a prescribed number of "significant barriers" have been encountered. Such electronics and logics circuitry can be provided with timing capability such that if the prescribed number of "significant barriers" are not encountered, a predetermined action(s) is taken. Such action options may include the following:

- Rendering of the munitions disarmed;
- Initiating the pyrotechnics materials of the device;
- Transmit information to a "fire control center", including its present location, the number of "significant barrier" impacts encountered; its state (armed or disarmed or the time to detonation, etc.); and/or other sensory information;
- Starting to collect sensory data and transmitting the said data to a "fire control center" for decision making purposes;
- Transmit homing signal for incoming munitions;
- Transmitting information as to the location of the munitions, and if an UXO, whether it is armed or disarmed;
- Expulsion of sensory and other devices, sub-munitions; warhead, etc.;
- Expulsion of the damage assessment devices and means of transmitting the collected information to a "fire control center" center.

A need therefore also exists for the development of novel methods of integrating piezoelectric-based electrical energy generation devices and the proper electronics and logics circuitry for performing one or more of the aforementioned tasks into the aforementioned mechanical inertia-based mechanisms for initiation of thermal batteries and other similar devices used in gun fired munitions, mortars, rockets, gravity dropped weapons and other types of munitions after the said munitions has impacted a prescribed number of "significant barriers".

In certain other applications, the munitions or any other system using the disclosed novel mechanical inertia-based mechanisms have a source of electrical energy and the pyrotechnic materials in thermal batteries or the like are required to be initiated by electrical initiation elements. In such applications, an embodiment of the disclosed novel mechanical inertia-based mechanisms is used as an electrical switch, for the purpose of opening or closing a circuit each time an aforementioned "significant barrier" is encountered. The available electrical power may then be used to power appropriate electronics and logics circuitry such that the number of encountered "significant barriers" could be counted and initiation command provided once a prescribed number of "significant barriers" have been encountered. The said command may be for initiation of a pyrotechnic material or the like or for the initiation of any other predetermined (programmed) actions.

In an alternative embodiment, at least one novel mechanical inertia-based mechanism is used that consists of at least one stage mechanism, which once the process of reaction to an impact with a "significant barrier" has ended, it would essentially return to its initial (pre-impact) state. The device also acts as an electrical switch, opening and/or closing once actuated due to the encountered impact with a "significant barrier". The numbers of "significant barriers" are then counted by the number of times that the device is actuated and returned to its initial state after encountering a "significant barrier".

In a variation of the above embodiment, the at least one novel mechanical inertia-based mechanism consists of several stages, each actuated at a predetermined impact induced acceleration level and each acting as en electrical switch as previously described. Then upon encountering impact with a "significant barrier", the aforementioned stages of the mechanical inertia-based mechanism would actuate sequentially as the impact induced acceleration level increases, each at different (increasing) acceleration level threshold, thereby allowing both impact occurrence as well as its induced acceleration level be determined (to the discrete threshold levels).

Reliability is also of much concern since the most munitions should have a shelf life of up to 20 years and could generally be stored at temperatures of sometimes in the range of −65 to 165 degrees F. This requirement is usually satisfied best if the igniter pyrotechnic is in a sealed compartment. The design of inertia based initiation devices must also consider the manufacturing costs and simplicity of the design to make them cost effective for munitions applications.

The need to differentiate accidentally induced accelerations such as accelerations due to dropping or during handling and transportation as well as firing setback and set forward accelerations from target impact induced accelerations necessitates the employment of novel inertia-based mechanisms that can safety and reliably make such comparisons. In addition, the said novel inertia-based mechanisms must be able to count the number of impacts with targets that constitute "significant barriers" since the devices that are to be activated by such novel inertia-based mechanisms may be required to be activated following a certain number of "significant barrier" encounters since cases most thermal batteries are not capable of withstanding shock loading due to a "significant barrier" encounter.

The novel inertia-based mechanisms described herein provide mechanical mechanisms that respond to accelerations that are induced due to target impact in the direction opposite to the munitions travel and that are above certain threshold. The disclosed inertial based mechanisms differentiate between accelerations in the same direction as the target impact induced accelerations, including the set forward acceleration, since the level of acceleration experienced by munitions during impact with a "significant barrier" is significantly higher than the aforementioned acceleration threshold.

The disclosed novel inertia-based mechanisms may have a multi-stage design. All stages of the device are however prevented from actuation (responding to impact with a "significant barrier") except for the first stage of the device. Then once an impact with a "significant barrier" is encountered, the first stage is actuated, and the next stage is enabled to actuate in response to an impact with the next "significant barrier". Thus, the different stages of the device sequentially detect impacts with the encountered "significant barriers". In such inertial-based mechanisms, each stage of the device stays in its actuated state following impact with a "significant barrier", while enabling the next stage of the device to actuate as a result of impact with the next "significant barrier". In one embodiment of the present invention, when a predetermined number of "significant barrier" impacts are encountered, the inertia-based mechanism initiates a pyrotechnic charges or the like. In another embodiment of the present invention, each said stage of the device acts as an "electrical switch" to provide an electrical or electronics and/or logics circuitry with a signal indicating the occurrence of such an impact with a "significant barrier". In another embodiment of the present invention, each said stages of the present novel inertia-based devices are composed of more than one mechanically actuated stage that are sequentially actuated and held in their actuated state when an increasing impact acceleration threshold is reached. As a result, these said devices can be used to detect impact with "significant barriers" as well as the level of the level of impact acceleration that it experiences within a discrete number of impact acceleration thresholds.

Alternatively, the novel inertia-based mechanisms may have at least one stage, which after encountering impact with a "significant barrier" and ensuing actuation, it returns to its initial stage. Each encountered actuation event of the inertia-based mechanism stage is then used to generate an electrical or mechanical signal that is used by an appropriate electrical device or electronics and/or logics circuitry, or mechanical mechanism to advance a counter or event detection mechanism, or perform certain sequential electrical, electronic or mechanical action. The action includes initiation of a pyrotechnic charge to initiate a thermal battery or the like or initiate a munitions detonation charge after a predetermined number of "significant barriers" are encountered or a prescribed amount of time has elapsed without such encounters. The initiation of pyrotechnic material may be electrical by an electrical initiator or mechanically by releasing, for example, a spring preloaded striker mass to initiate the pyrotechnic material by impact energy.

The actuation of the at least one stage novel inertial-based mechanism may also be used to act as an electrical switch to open or close a circuit to provide the signal indicating detection of an encounter with a "significant barrier".

When electrical power is required to power the electronics and/or logics circuitry of the device and/or for initiating the pyrotechnics materials of the device, the electrical energy is preferably generated by piezoelectric elements during one or more of encountered high G events such as firing setback or set forward accelerations or impact shock when encountering "significant batteries" or during the munitions fight as a result of vibration and/or oscillatory motions. In such applications, the available electrical power may be used to power appropriate electronics and logics circuitry such that the number of encountered "significant barriers" could be counted and initiation command provided once a prescribed number of "significant barriers" have been encountered. Such electronics and logics circuitry would preferably be provided with timing capability such that in the prescribed number of "significant barriers" are not encountered, a predetermined action(s) is taken. Such action options may include one or more of the aforementioned actions, such as disarming the device, transmitting a signal as to its status, etc., as previously described.

The ignition of pyrotechnic material may take place as a result of striker impact, or simply contact or proximity or a rubbing action. For example, the striker may be akin to a firing pin and the target akin to a standard percussion cap primer. Alternately, the striker-target pair may bring together one or more chemical compounds whose combination with or without impact or a rubbing will set off a reaction resulting in the desired ignition.

Those skilled in the art will appreciate that the basic novel method for the development of inertial igniters that can detect munitions encounter with "significant barriers" disclosed herein may provide one or more of the following advantages over prior art mechanical and/or electrical and/or electronics equipped with accelerometers or the like and related electronics, with and without microprocessor units or the like, in addition to the previously indicated advantages:

provide the means to initiate thermal battery or the like pyrotechnics after munitions has encountered a prescribed number of "significant barriers";

provide the means of turning an electrical "switch" on or off to render an electrical circuit open or closed;

provide the means to generate an electrical pulse after each "significant barriers" encounter;

provide the means to incorporate any possible time delay period that may be required for inertial igniters and other similar applications;

provide inertial igniters with mechanical means of detecting and "counting" munitions encounters with "significant barriers" and initiating pyrotechnic materials or performing certain other actions once a specified number of such "significant barriers" have been encountered;

provide mechanical means of detecting and "counting" munitions encounters with "significant barriers" as well their levels of impact shock and initiating pyrotechnic materials or performing certain other actions once a specified number of such "significant barriers" have been encountered;

provide methods of developing mechanical means of detecting and "counting" munitions encounters with "significant barriers" as well their levels of impact shock and activating and initiating pyrotechnic materials or performing certain other actions once a specified number of such "significant barriers" have been encountered;

making it possible to provide the said inertial igniters for thermal batteries and the like in very small packages and without requiring external power sources; and provide inertial igniters that can be sealed in a package to simplify storage and increase their shelf life.

In this disclosure, novel and basic methods are presented that are used for compact mechanisms for miniature inertial igniters for initiation of thermal batteries and the like that can detect impacts with "significant barriers", count the number of such encounters with "significant barriers", and initiate the thermal battery or the like once a predetermined number of such encounters has occurred and/or provide this information to an electrical or electronics device in the form of switching actions to open or close a circuit or send a pulse by first opening (closing) a circuit and then opening (closing) the circuit or the like. The method is based on the employment of a mechanical mechanism that does not react to firing setback and set-forward accelerations, but sequentially reacts to each munitions impact with a "significant barrier" at/near target location. In this mechanical mechanism, each sequential "significant barrier" encounter causes a sequential actuation of a series of actuation stages of the said mechanical mechanism. In an alternative design, an actuation stage returns to its pre-actuation configuration following an encounter with a "significant barrier", while in the process causing an electrical, electronic or mechanical "counter" or "switch" or "pulsing" mechanism to be operated. The device may be provided with several actuation devices, each designed to be actuated at different level of impact shock acceleration level, thereby allowing measurement of the level of impact shock within the provided levels that has been experienced by munitions during each encounter with a "significant barrier".

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 1:
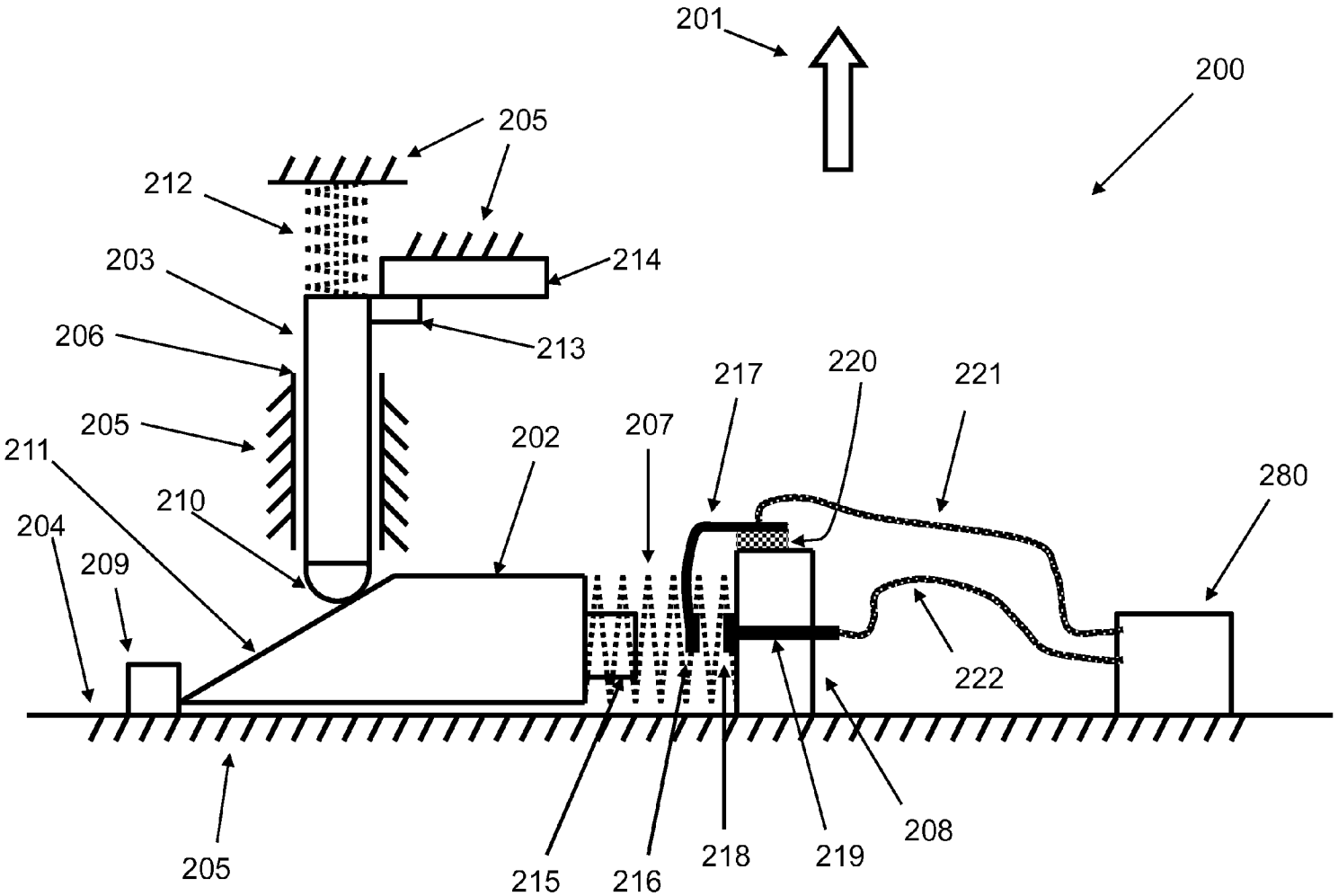
FIG. 1 illustrates the schematic of one embodiment of a "significant barrier" encounter event detection mechanism.

An embodiment 200 of a highly compact mechanisms and method for detecting "significant barrier" encounter events and providing the means to count the number of such encounter events for use in miniature inertial igniters for thermal batteries or other safe and arm devices and the like and their operation is shown in the schematic of FIG. 1. The device 200 is designed to close an electrical circuit by causing two contacts that keep the circuit open to come into contact when the device is subjected to an acceleration in the direction of the arrow 201 as a result of encountering a "significant barrier", i.e., as a result of impact shock caused by the munitions encountering a "significant barrier".

The device 200 mechanism consists of the main moving elements 202 and 203. The element 202 can slide back and forth (to the right and left as seen in the schematic of FIG. 1 over the surface 204 of the device structure 205. The element 203 is provided with a guide 206, which is preferably provided in the structure 205 of the device 200 or is fixed to the said device structure 205. The element 202 is biased to its left-most position by the compressive spring 207, which rests against the stop 208 provided on the device structure 205. The element 202 is preferably held in its left-most position by the stop 209. Alternatively, the element 202 may be held in its left-most position by the tip 210 of the element 203, which is pressed against the inclined surface 211 of the element 202 by the compressive spring 212. The element 203 may be provided with a protrusion 213 which limits its upward motion by coming against the stop 214 provided on the device structure 205.

The element 203 is provided with certain amount of mass so that when the device 200 is subjected to an acceleration in the direction of the arrow 201, the force exerted by the tip 210 of the element 203 on the inclined surface 211 of the element 202 is proportionally increased. The spring elements 212 and 207 are also provided with certain amount of compressive preloading such that until certain acceleration level is reached the element 202 would not begin to displace (to the right). The spring rates of the spring elements 212 and 207 are also selected such that as a specified acceleration level corresponding to the aforementioned encounter with a "significant barrier" is reached, the force exerted by the tip 210 due to the acceleration acting on the mass of the element 203 is large enough to displace the element 202 far enough (to the right as seen in the schematic of FIG. 1) to cause the portion 215 of the element 202 to press against the flexible metal (strip) element 217 to bend, thereby bringing the contact elements 216 and 218 into contact. The flexible metal element 217 is fixed to the device structure 205 while being electrically isolated from the device structure by the non-conducting material member 220 (in the schematic of FIG. 1, via the stop 208). The contact 218 is in turn attached to a conducting element 219, which is preferably electrically isolated from the device structure 205 (and in the case of the schematic of FIG. 1, from the stop member 208) by similar non-conducting materials (not shown). The electrical wires 221 and 222 are attached to the flexible metal element 217 and the conducting element 219, respectively, and provide the means of closing a circuit once the contacts 216 and 218 come into contact as described above due to the device 200 experiencing an acceleration in the direction of the arrow 201 that is at the prescribed level or above that would be experienced by the munitions using the device 200 when it encounters a "significant barrier".

When used to initiate the pyrotechnic materials in a thermal battery or initiate pyrotechnic materials or the like in other devices, an electronic circuitry and logic device or a microprocessor 280, FIG. 1, hereinafter referred to as the "control unit", is used for collecting and processing of the device 200 encounters with "significant barriers". During each "significant barrier" encounter, the control unit 280 registers the encounters and when the prescribed number of "significant barriers" has been encountered, it would initiate the process of igniting the intended pyrotechnic material. In general, the "control unit" is also designed to either initiate the pyrotechnic material ignition or initiate a disarming process if the prescribed number of "significant barrier" is not encountered within a prescribed amount of time, which could indicate that the desired target has not been reached. Here, if an electrical initiation device is being used, the latter process generally involves the passing a high enough current through the electrical initiation filament or the like to heat or produce sparks to ignite the surrounding pyrotechnic material (such as by discharging the energy stored in a provided capacitor). The design and construction of such "control units" and the electrically initiated igniters (filament and other types) are well known in the art and are not discussed in the present disclosure.

Figure 2:
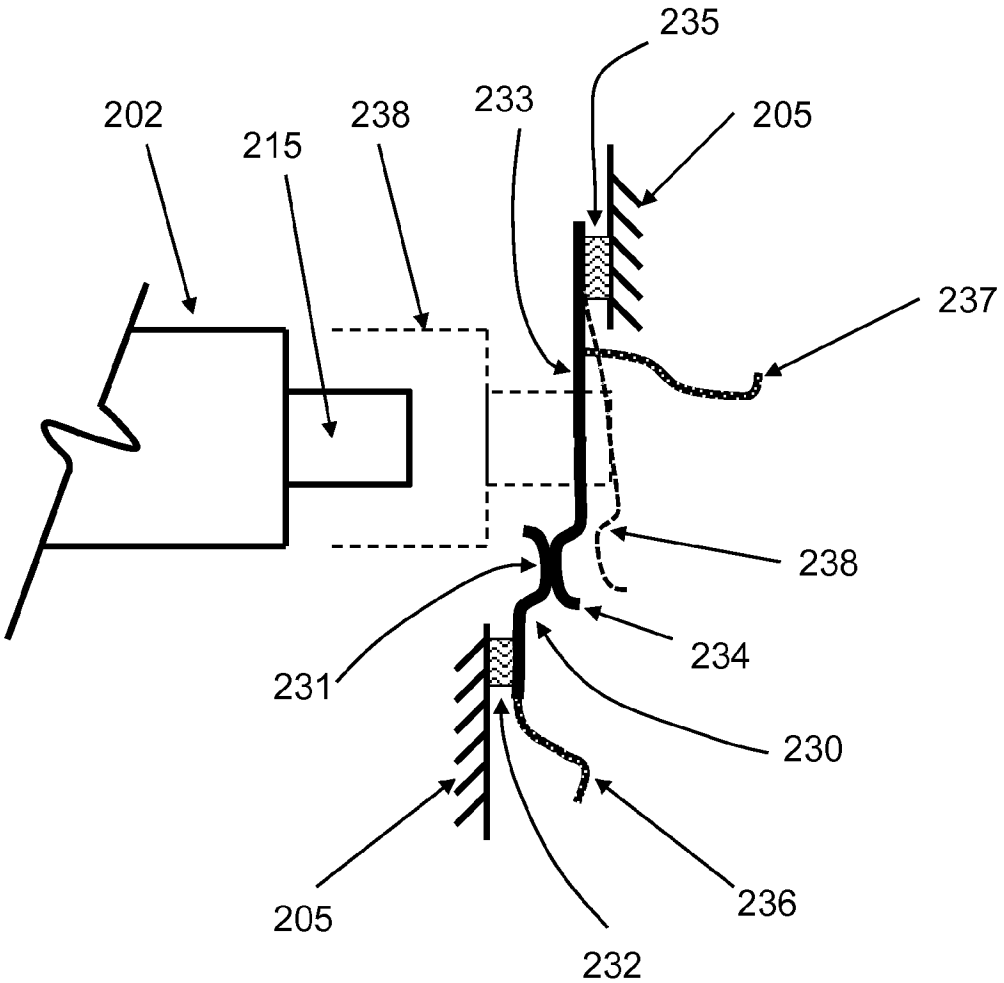
FIG. 2 illustrates the schematic of an alternative embodiment of the "significant barrier" encounter event detection mechanism of FIG. 1.

It is appreciated by those skilled in the art that the device 200 shown in the schematic of FIG. 1 may be readily modified to open a normally closed circuit. This can, for example, be achieved as shown in FIG. 2 that illustrates changes to be made to the electrical contact region of the device 200 of FIG. 1. In this alternative design, the first (relatively flexible and electrically conductive) contact element 230 with the contact end 231 is attached to the device 200 structure 205 with an isolating non-conducting element 232. The second (relatively flexible and electrically conductive) contact element 233 with the contact end 234 is also attached to the device 200 structure 205 with an isolating non-conducting element 235. The contact points 231 and 234 are normally in contact, thereby keeping a circuit connected through the electrically conductive contact element 230 and 233 via wires 236 and 237, respectively, closed. However, when the device 200 is subjected to acceleration in the direction of the arrow 201 as shown in FIG. 1 due to the munitions using the device 200 encountering a "significant barrier", then the element 201 and its end member 215 (also shown partly in FIG. 2) is forced to move rightward as was previously described and shown in dashed lines in FIG. 2 and in combination enumerated with numeral 238. The end member 215 (dashed lines) will then force the contact element 233 to bend away from the contact element 230, thereby causing contact between their contact points 231 and 234 to be lost, thereby causing the aforementioned electrical circuit to be rendered open.

It is appreciated by those skilled in the art that since in the embodiments of FIGS. 1 and 2 the number of "significant barrier" encounters are counted electronically by the "control unit" 280, the preferred type of initiation device to be used for the ignition of the pyrotechnic material of the thermal battery or other devices would be an electrical initiator.

It is noted that in the embodiments shown in FIGS. 1 and 2, once the aforementioned encounter with a "significant barrier" has ended, the electrical contacts return to their original state and the closed or opened circuit would also returns to its original state. Such embodiments are preferably used to provide an essentially pulse signal to the system electronics and logics circuitry for "significant barrier" encounter counting and/or decision making purposes. It is appreciated by those skilled in the art that the device 200 shown in the schematic of FIG. 1 (or the alternative design shown in FIG. 2) may be readily modified to close a normally open circuit (or open a normally closed circuit) and keep the circuit in its closed (opened) state after the aforementioned encounter with a "significant barrier" has ended.

Figure 3:
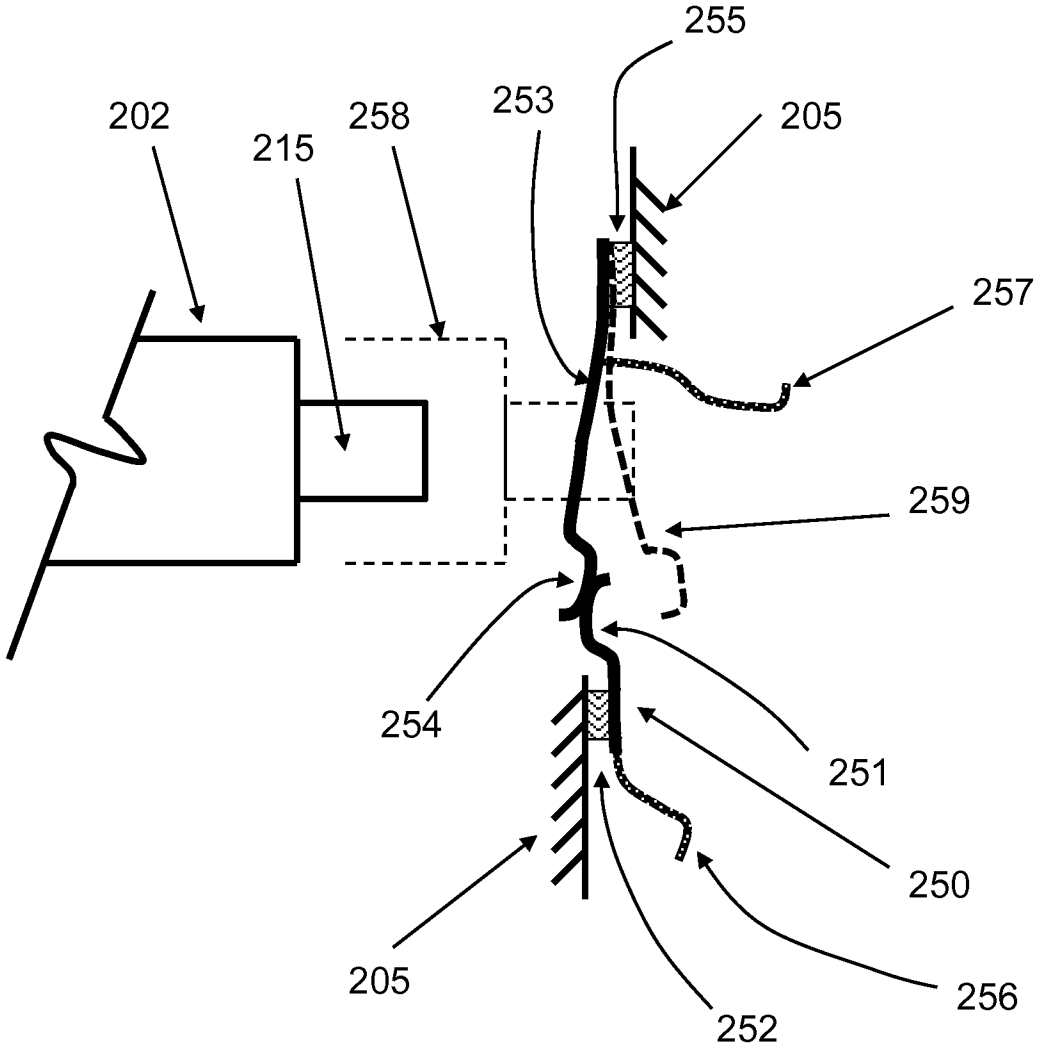
FIG. 3 illustrates the schematic of another alternative embodiment of the "significant barrier" encounter event detection mechanism of FIG. 1.

As an example, this can be readily achieved for the normally closed circuit embodiment of FIG. 2 by the following minor modification in the design of the contact element shown in FIG. 2. In the modified design, the schematic of which is shown in FIG. 3, the first (relatively flexible and electrically conductive) contact element 250 with the contact end 251 is attached to the device 200 structure 205 with an isolating non-conducting element 252. The second (and flexible and electrically conductive) contact element 253 with the contact end 254 is also attached to the device 200 structure 205 with an isolating non-conducting element 255. The contact points 251 and 254 are normally in contact, thereby keeping a circuit connected through the electrically conductive contact element 250 and 253 via wires 256 and 257, respectively, closed. The contact element (flexural beam) 253 is preloaded (in bending) to bring its contact point 254 into contact with the contact point 251, and in its free state, i.e., without the contact point 251 preventing it from returning to its free state, it would come to rest at its free state shown in dashed line and indicated by the numeral 259.

When the device 200 is subjected to acceleration in the direction of the arrow 201 as shown in FIG. 1 due to the munitions using the device 200 encountering a "significant barrier", then the element 202 and its end member 215 (also shown partly in FIG. 2) is forced to move rightward as was previously described and shown in dashed lines in FIG. 3 and in combination enumerated with numeral 258. The end member 215 (dashed lines) will then force the contact element 253 to bend towards its free state 259 and pass over the contact point 251, thereby causing contact between the contact points 251 and 254 to be lost, thereby causing the aforementioned electrical circuit to be rendered open. Then once the acceleration in the direction of the arrow 201 as shown in FIG. 1 due to the munitions using the device 200 encountering a "significant barrier" has ended, the contact element 253 and its contact point 253 will return to its free state 259. As a result, the contact between the contact points 251 and 254 and thereby the aforementioned electrical circuit will stay open.

It is appreciated by those skilled in the art that the "significant barrier" event detector embodiment of FIG. 3 can be used for only a single measurement of such an event. This is the case since unlike the embodiments of FIGS. 1 and 2, the contact elements do not return to their original positions following a "significant barrier" encounter.

In another embodiment, the basic mechanism of the device 200 shown in the schematic of FIG. 1 is used to respond to a "significant barrier" encounter of the munitions into which the device 200 is installed as previously described. However, instead of using normally open or close electrical contacts, a mechanical means such as a "mechanical counter" is employed and is advanced each time the device 200 experiences an encounter with a "significant barrier". Many different types of "mechanical counters" that advance upon each full actuation of the mechanism of the device 200 (i.e., each rightward travel of the element 202 towards the stop 208) are known in the art and may be used. One such preferred mechanism is a ratchet type mechanism as shown in the schematic of FIG. 4.

Figure 4:
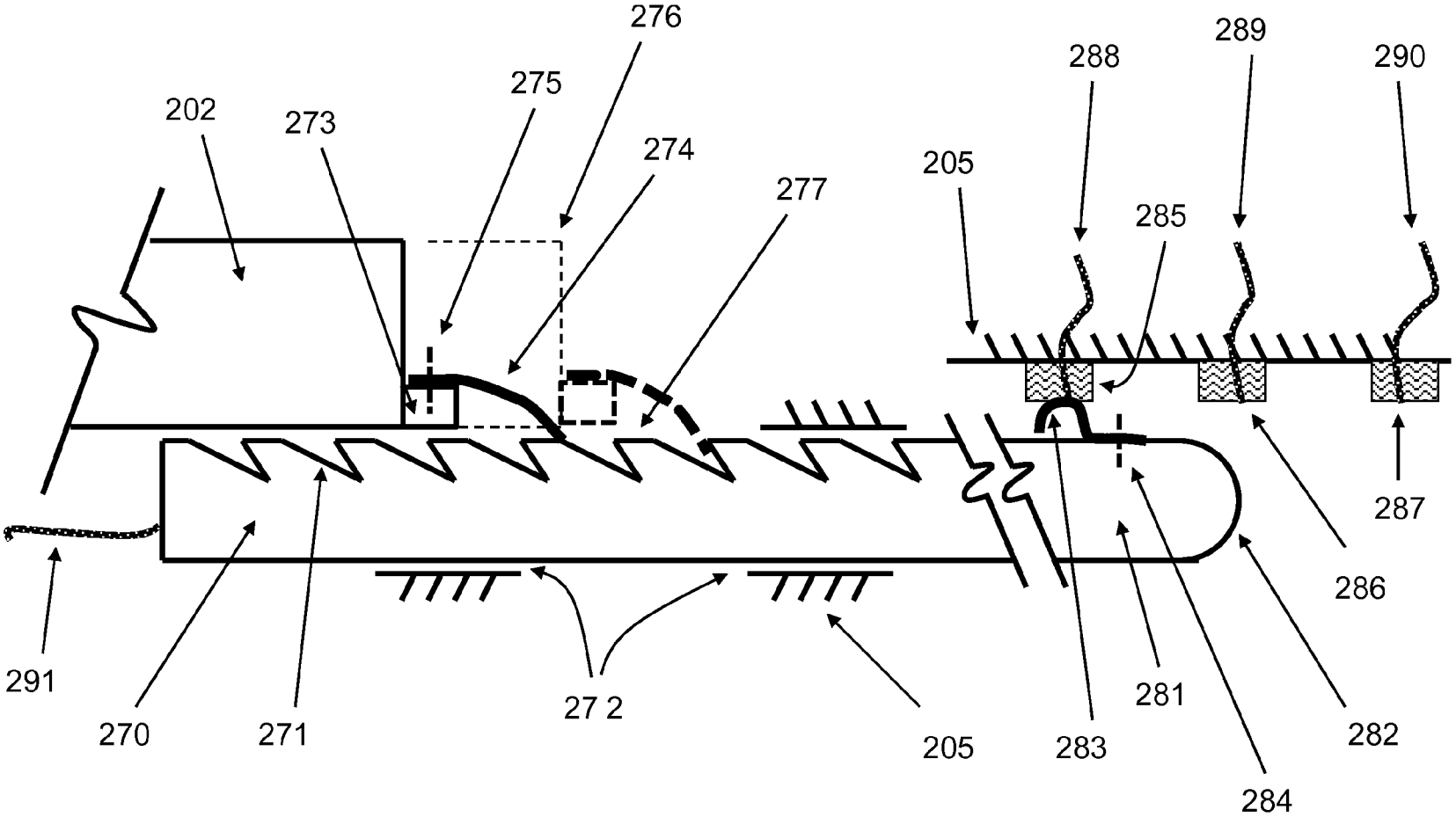
FIG. 4 illustrates the schematic of another alternative embodiment of the "significant barrier" encounter event detection mechanism of FIG. 1 which uses a mechanical mechanism to "count" the number of encountered events.

In the schematic of FIG. 4, the mechanical event detection mechanism is shown to consist of a linear ratchet member 270, which is provided with the ratcheting teeth 271. The ratchet member 270 can slide in a guide 272 provided in the structure of the device 200. The guide 272 is preferably provided with enough friction or with a spring loaded friction pad (not shown) to require certain amount of force for the ratchet member 270 translate within the guide 272. A flexible ratchet "pawl" 274 is fixed to the end member 273 of the translating element 202 as shown in FIG. 4, such as without the use of a fastener 275, for example by pressing its fixed end into a cut provided on the member 273. It is noted that a generally hinged and spring-loaded pawl commonly used in ratchet mechanisms could also be used instead of the flexible element 274. However, since the device 200 is intended to be as small as possible, the use of the indicated flexible ratchet "pawl" 274 type element would occupy a significantly smaller device volume, particularly since the "pawl" 274 is only required to transmit a relatively small force to overcome the friction between the ratchet member 270 and its guide 272.

When the device 200 is subjected to acceleration in the direction of the arrow 201 as shown in FIG. 1 due to the munitions using the device 200 encountering a "significant barrier", then the element 202 (shown partly in FIG. 4) and its end member 273 is forced to move rightward as was previously described and shown in dashed lines in FIG. 4 and in combination enumerated with numeral 276. The end member 273 (dashed lines) will then cause the flexible ratchet "pawl" 274 to push the ratchet member 270 rightward and translate it one ratchet step. It is noted that the stop 208 shown in FIG. 1 ensures controlled (rightward) translation of the ratchet element 270. Then once the acceleration in the direction of the arrow 201 as shown in FIG. 1 due to the munitions using the device 200 encountering a "significant barrier" has ended, the element 202 and its end element 273 are returned to its original state by the spring element 207 (FIG. 1) as shown with solid lines in FIG. 4. The flexible ratchet "pawl" 274 is then pulled out of its present ratcheting teeth 271, flexed over the top surface 277 of the ratchet member 270, and is positioned in the next ratcheting teeth 271 (or on the next top surface section of the ratchet member 270 as shown in FIG. 4. The device 200 is now ready to detect the next "significant barrier" encounter and advance the ratchet member 270 another step forward.

As a result, the device 200 can indicate the number of encountered "significant barriers"; be used with contact elements shown in the schematics of FIGS. 1-3 when a prescribed number of such "significant barrier" encounters; actuate a mechanical mechanism such as actuating a mechanical device or releasing a spring loaded element to initiate a pyrotechnic loaded element such as a percussion cap; etc.

For example, as is shown in the schematic of FIG. 4, the ratchet member 270 may be provided with an end region 281 and a tip 282. An electrically conductive contact element 283 is attached to the side of the end 281 of the ratchet member by, for example, a fastener 284. At least one contact (three contacts 285, 286 and 287 are shown in the schematic of FIG. 4) is attached to the base structure 205 of the device 200 (FIG. 1). The surfaces of the contact 285, 286 and 287 are covered by electrically conducting materials, isolated electrically from the base structure 205 (not shown), and are connected to the electrically conductive wires 288, 289 and 290, respectively. Then as the ratchet member 270 is advanced one notch as the device 200 encounters a "significant barrier", the contact element is brought into contact with the contact 285, thereby closing the electrical circuit between the electrically conductive wires 288 and 291 (attached to the electrically conductive ratchet member 270 or directly to the contact element 283—not shown in FIG. 4). Each consequent encounter with a "significant barrier" will then advance the ratchet member one notch, thereby advancing the contact element 283 to the contact 286, and next to the contact 287 and so on. The wires 288, 289, 290 and 291 are in turn connected to the control unit of the device 200, FIG. 1, which can then determine the number of encountered "significant barriers" and when the prescribed number of "significant barriers" have been encountered would initiate its programmed task, such as initiating pyrotechnic materials of a thermal battery or the like.

In addition, as previously indicated, the advancing movement of the ratchet member 270 may be used to initiate mechanical ignition of thermal battery or the like pyrotechnic material when a prescribed number of "significant barriers" has been encountered. In general, the following three basic methods can be used to design such mechanical initiation devices.

Figure 6:
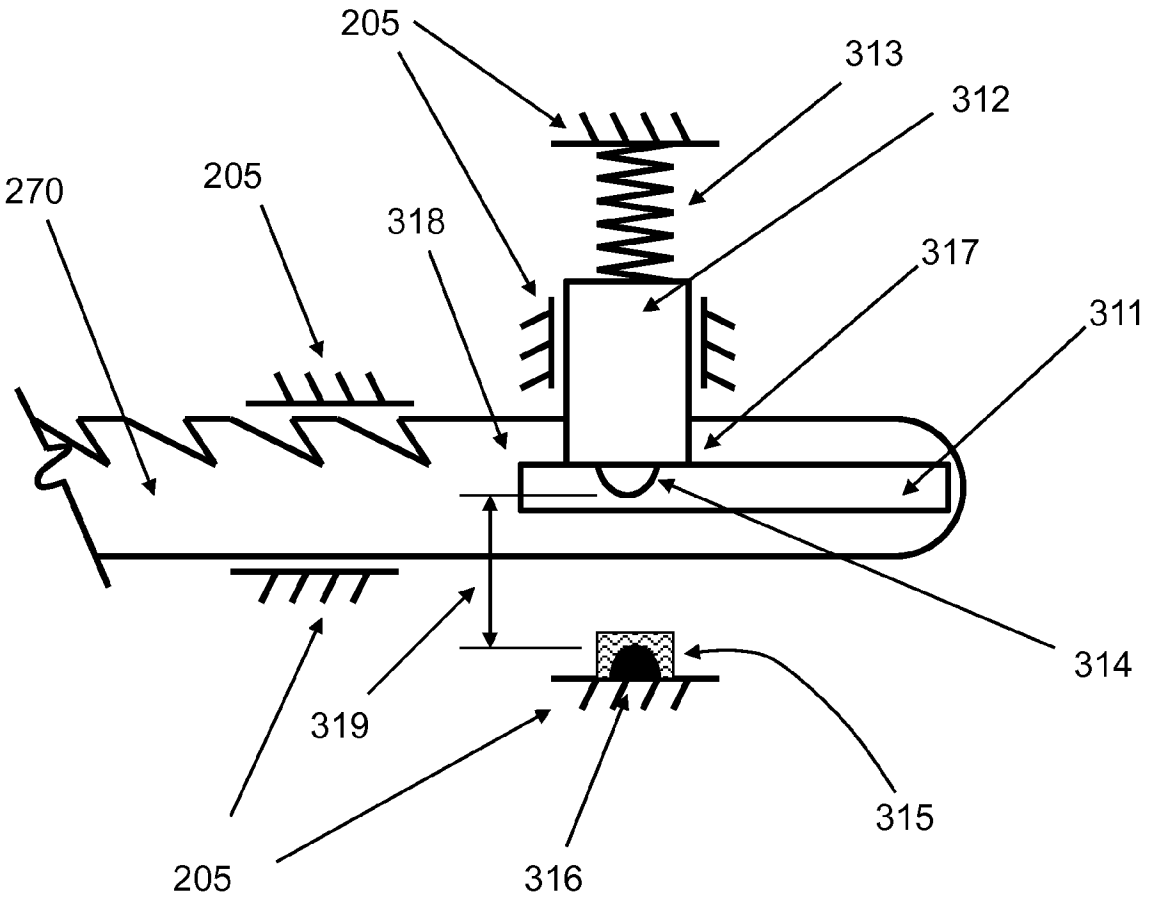
FIG. 6 illustrates the schematic of another embodiment of the "significant barrier" encounter event detection device.

In the first method, after the prescribed number of "significant barriers" have been encountered, i.e., after the ratchet member 270 has been advanced the prescribed number of notches, a spring preloaded "hammer mass" element 312 is caused to be released and impact the provided pyrotechnic material, thereby causing it to ignite as shown in the schematic of FIG. 6. In the schematic of FIG. 6 only one end of the ratchet member 270 is shown together with the indicated added pyrotechnic material initiation components. In this embodiment, an edge element 311 is fixed to the side of the ratchet member 270. A "hammer mass" element 312 is provided (which can be provided with a up-down sliding guide—not shown for clarity), which engages the top surface of the edge element 311 as shown in FIG. 6 and can ride along the top surface of the edge element 311 as the ratchet member 270 is advanced (to the right) as the device 200 encounters "significant barriers". The "hammer mass" element 312 is provided with a compressively preloaded spring element 313, which provides a force pressing the "hammer mass" element 312 down against the top surface of the edge element 311. The "hammer mass" element is preferably provided with a protruding element 314, which preferably rides in front of the edge element 311 to minimize the chances that it would "dig" into the top surface of the edge element 311 and thereby making it difficult for the ratchet member 270 to advance. The device 200 is also provided with pyrotechnic material 315, which is positioned as shown in FIG. 6 over the base structure 205 and in the path of downward motion of the "hammer mass" element 312. The surface of the base structure 205 covered by the pyrotechnic material 315 can be provided with a protrusion 316, which would act as an anvil as described below. The surfaces of the protruding elements 314 and 316 are preferably hard enough so that their impact as described below would cause minimal plastic deformation.

The "significant barrier" impact detecting device 200 equipped with the embodiment of FIG. 6 will then operate as follows. As the device 200 encounters "significant barriers", the ratchet member 270 is advanced one notch for each such encounter as previously described. As the ratchet member 270 advances (to the right as seen in the schematic of FIG. 6), the "hammer mass" element 312 slides (to the left) over the edge element 311. Then during that prescribed "significant barrier" encounter, as the edge element 311 travels to the right, the edge 317 of the "hammer mass" element 312 moves past the end edge 318 of the edge element 311, thereby freeing the "hammer mass" element 312 to move downwards towards the pyrotechnic material 315. At this time, the compressively preloaded spring 313 would force the "hammer mass" element 312 to be accelerated downward towards the pyrotechnic material 315, and impact it at relatively high speed. The force of such impact would then pinch the pyrotechnic materials 315 between the surfaces of the protruding elements 314 and 316, causing the pyrotechnic material to be ignited. It is appreciated by those skilled in the art that the amount of impact energy that is required for ignition of the pyrotechnic material 315 is dependent on the type of the pyrotechnic material, which is either known for most commonly used pyrotechnic materials or can be readily determined experimentally. The amount of impact energy imparted by the "hammer mass" element 312 is dependent on the amount of preload and stiffness of the spring 313, the mass of the "hammer mass" element 312 and the distance 319 (FIG. 6) that the "hammer mass" element 312 travels (is accelerated) before the impact. Therefore, by selecting appropriate values for the parameters, the impact energy required to reliably initiate the pyrotechnic material 315 can be achieved.

Figure 7:
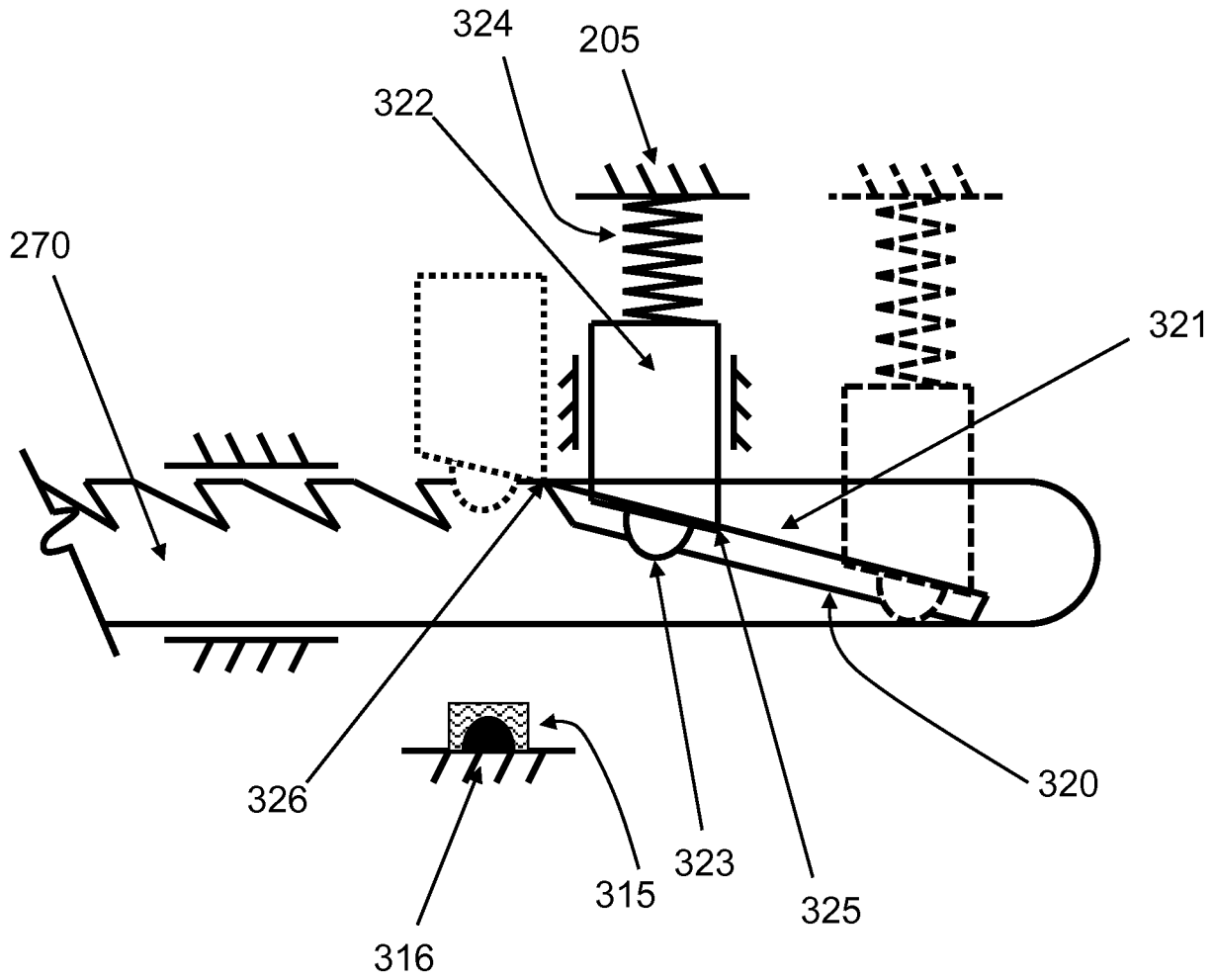
FIG. 7 illustrates the schematic of yet another embodiment of the "significant barrier" encounter event detection device.

In a second method, the spring element (element 313 in the embodiment of FIG. 6) that drives "hammer mass" element (element 312 in the embodiment of FIG. 6) is not initially preloaded (in compression in FIG. 6), and the advancement of the ratchet member 270 causes the spring element to be preloaded as the device 200 encounters "significant barriers". One such embodiment is shown in the schematic of FIG. 7. This embodiment is similar to the embodiment of FIG. 6, except that the edge element 320 (311 in the schematic of FIG. 6) is made with an inclined top surface 321, over which the "hammer mass" element 322 rides. The "hammer mass" element 322 can be provided with a protruding element 323, which can ride in front of the edge element 320 to minimize the chances that it would "dig" into the top surface of the edge element 320 and thereby making it difficult for the ratchet member 270 to advance. The spring element 324 (313 in the schematic of FIG. 6) is provided to similarly drive the "hammer mass" element towards the pyrotechnic material 315. The "hammer mass" element 322 is initially at the right-most position (shown in dashed lines) of the ratchet member 270. Then as the ratchet member 270 is advanced to the right as the device 200 encounters "significant barriers", the inclined edge element 320 pushes the "hammer mass" element 322 up as can be seem in the schematic of FIG. 7, from its initial dashed position towards the solid lined position and then towards the dotted lined position. As can be seen in the schematic of FIG. 7, as the "hammer mass" element 322 is moved upwards, the spring element 324 is preloaded in compression. Further advancement of the ratchet member 270 pushes the bottom left edge 325 of the "hammer mass" element 322 past the left-most edge 326 of the edge element 320, thereby freeing the "hammer mass" element 322 to move downwards towards the pyrotechnic material 315. At this time, the compressively preloaded spring 324 would force the "hammer mass" element 322 to be accelerated downward towards the pyrotechnic material 315, and impact it at relatively high speed. The force of such impact would then pinch the pyrotechnic materials 315 between the surfaces of the protruding elements 323 and 316, causing the pyrotechnic material to be similarly ignited.

Figure 8:
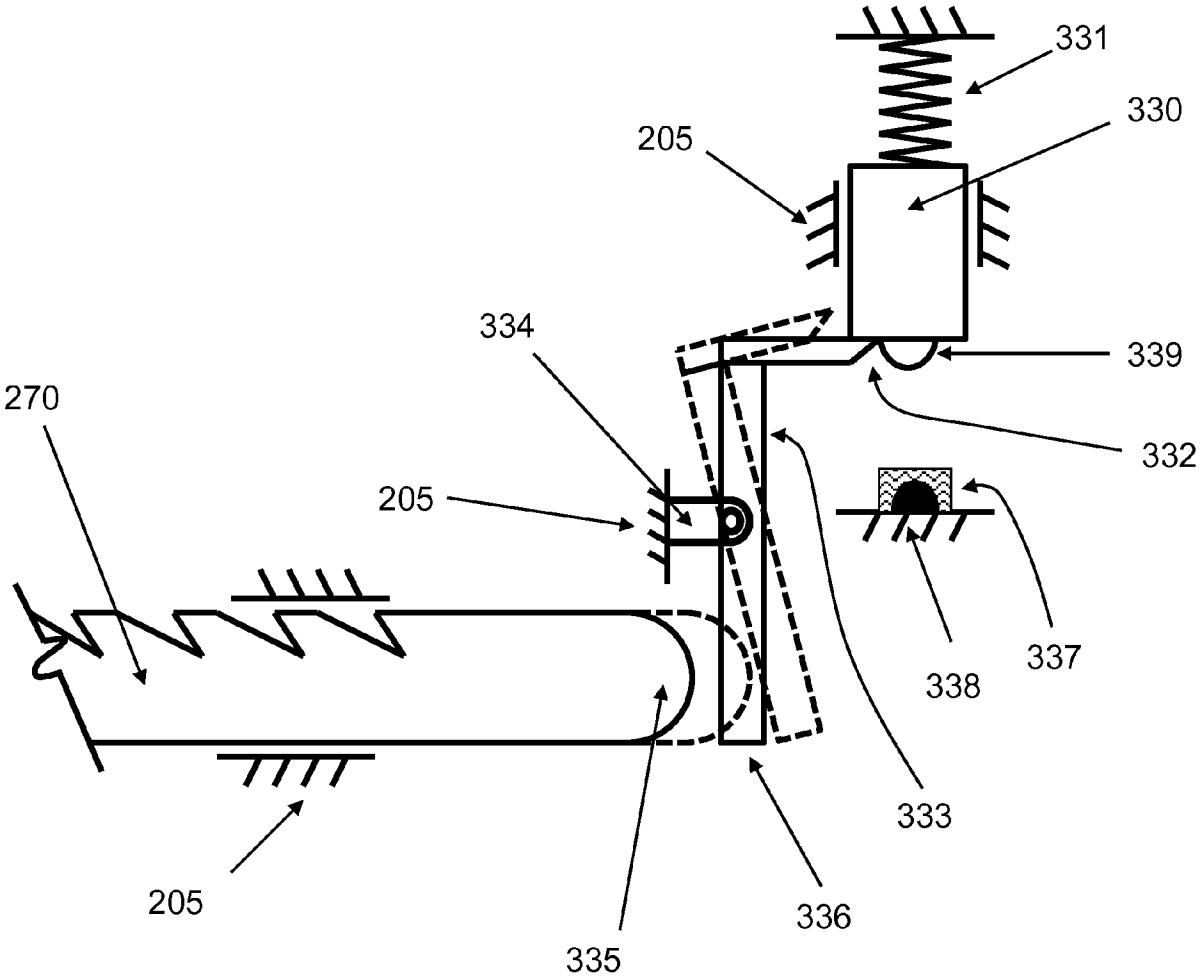
FIG. 8 illustrates the schematic of yet another embodiment of the "significant barrier" encounter event detection device.

In a third method, the ratchet member 270 is to actuate a mechanism that would in turn release a "hammer mass" element, which is driven by a preloaded spring to similarly impact the pyrotechnic material and cause it to ignite. An example of such an embodiment is shown in the schematic of FIG. 8. In this embodiment, a "hammer mass" element 330 and a compressively preloaded spring 331 similar to those used in the embodiment of FIGS. 6 (312 and 313, respectively) are also used. The "hammer mass" element 330 is held in its position with the compressively preloaded spring 331 by the tip 332 of the rotating link 333 (solid line). The rotating link 333 is attached to the base structure 205 by a rotary joint 334. Then as the ratchet member 270 is advanced to the right as the device 200 encounters "significant barriers", when the prescribed number of "significant barriers" are encountered, the end 335 of the ratchet member 270 reaches the end 336 of the link 333 (solid line) and begin to rotate the link in the counterclockwise direction (shown in dashed lines in the schematic of FIG. 8), thereby releasing the "hammer mass" element 330, thereby freeing the "hammer mass" element 330 to move downwards towards the pyrotechnic material 337. At this time and as it was described for the embodiment of FIG. 6, the compressively preloaded spring 331 would force the "hammer mass" element 330 to be accelerated downward towards the pyrotechnic material 337, and impact it at relatively high speed. The force of such impact would then pinch the pyrotechnic materials 315 between the surfaces of the protruding elements 338 and 338 (similar to the protruding elements 314 and 316 in the embodiment of FIG. 6), causing the pyrotechnic material 337 to be ignited.

It is appreciated by those skilled in the art that the ratchet type "significant barrier" encounter detection based initiation devices shown in the schematics of FIGS. 6-8 would only initiate when the prescribed number of impacts are not encountered. These embodiments are particularly suitable in applications in which if the prescribed number of "significant barriers" are not encountered, the thermal battery or other type of devices (e.g., various gun fired munitions, mortars, rockets, missiles or gravity dropped weapons) operating by the initiation of pyrotechnic materials are not desired to operate.

In the schematics of FIGS. 6-8, the "hammer mass" element driving spring is shown to be a compressively loaded. It is, however, appreciated by those skilled in the art that by attaching the spring to the base structure 205 on the opposite side (below) the ratchet member, one could also construct the mechanisms to operate with springs that are preloaded in tension. Tensile preloading of springs is usually more stable than those preloaded in compression.

In the schematic of FIG. 4, a linear type of ratchet mechanism is shown to be employed for detecting ("counting") the number of encountered "significant barriers". However, it is appreciated by those skilled in the art that a rotary type ratchet mechanism or any other mechanical intermittent motion mechanism may also be used for this purpose as well.

In certain applications, in addition of detecting ("counting") the number of encountered "significant barriers", it is also desired to determine the corresponding level of each encountered impact force. The level of encountered impact force is usually desirable for the purpose of determining the strength of the encountered significant barrier. In addition, in certain cases it is desired to also know the time history (i.e., the profile) of the encountered impact force, since such a profile can give an indication of the strength, type and thickness of the encountered "significant barrier". The following embodiments describe inertia-based devices that address such needs.

Figure 5:
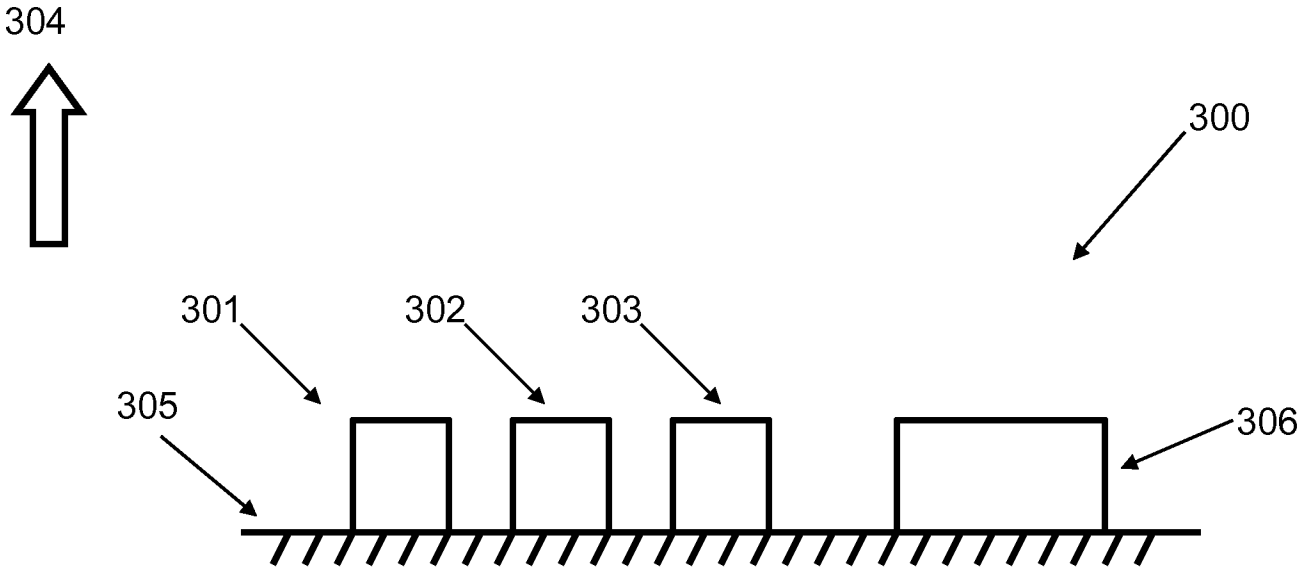
FIG. 5 illustrates the schematic of another embodiment of the "significant barrier" encounter event detection device, which is capable of counting the number of such encounters and their impact acceleration (force) levels.

In one embodiment, at least two novel mechanisms 200 of the type shown in the schematic of FIG. 1, with the "significant barrier" detecting normally open contacts 216 and 218, or its alternative normally closed contacts shown schematically in FIG. 2, or their combinations, are used. Hereinafter and for the sake of simplicity, the embodiment 200 and its variations shown in FIGS. 1 and 2 are referred to as simply "barrier detectors". Now consider the case in which the embodiment 300 shown schematically in FIG. 5 is constructed with three "barrier detectors" indicated by the numerals 301, 302 and 303. The "significant barrier" encounter detecting ("counting") device 300 is intended to detect "significant barrier" encounters as well as their corresponding impact force levels. The three "barrier detectors" 301, 302 and 303 are identical, except for the spring rates of one or both spring elements 207 and 212 and/or their amounts of preloading, and/or the inertia (mass) of element 202 and/or 203, and/or the slope of the inclined contact surface 211, FIG. 1. It is appreciated by those skilled in the art that making any one of the above changes, the contact elements 216 and 218 would come into contact at different device acceleration in the direction of the arrow 201, FIG. 1 (or open the contacts 231 and 234 in the embodiment of FIG. 2). For example, by increasing the spring rate of the spring element 270, FIG. 1, the level of acceleration in the direction of the arrow 201 at which contacts elements 216 and 218 come into contact (i.e., that the device "register" or a "significant barrier" count, is increased). As another example, a similar effect is achieved by reducing the inertia (mass) of the element 203. It is appreciated by those skilled in the art that similar effects, i.e., the level at which the device 200 would count a "significant barrier" encounter may be increased or decreased by appropriate changes in the aforementioned changes in the parameters of the device 200.

The inertia-based "significant barrier" counting and corresponding impact level force detecting device 300 operates as follows. As an example, let the three "barrier detectors" 301, 302 and 303 be designed to detect (open or close contacts as previously described for the embodiments of FIGS. 1 and 2) a "significant barrier" causing acceleration in the direction of the arrow 304 on the platform 305 (for example a projectile) to which they are attached as shown in FIG. 5. Let, for example, the "barrier detector" 301, 302 and 303 be designed to detect "significant barrier" induced acceleration levels of 20,000 G, 40,000 G and 60,000 G, respectively, each corresponding to similarly increasing level of encountered impact force (their corresponding impact force levels being dependent on the structural characteristic of the projectile 305). Then as the platform (projectile) 305 encounters a "significant barrier" that result in an acceleration level in the direction of the arrow 304 of say 30,000 G, then only the "barrier detector" 301 would detect a "significant barrier" encounter. If the acceleration level is around 50,000 G, then the "barrier detectors" 301 and 302 would detect such a "significant barrier" encounter. If the acceleration level is above 60,000 G, then all three "barrier detectors" 301, 302 and 303 would detect the "significant barrier" encounter.

In an embodiment, an electronic circuitry and logic device or a microprocessor 306, hereinafter referred to as the "counter", FIG. 5, is used for collecting and processing of the "barrier detector" 300 encounters with "significant barriers". During each "significant barrier" encounter, the "counter" 306 registers the encounters detected by each one of the three "barrier detectors" 301, 302 and 303. The number of "significant barrier" encounters and their impact force levels are then determined by each "barrier detector" detection generated signal (contact opening or closing for the case of embodiments of FIG. 1 or 2) and their relative timing as follows.

It is appreciated by those skilled in the art that when the platform 305 (for example a projectile or the like) impacts a "significant barrier" that generates acceleration levels in the "barrier detectors" 301, 302 and 303 that is in this case above the aforementioned 60,000 G, the "significant barrier" is first detected by the "barrier detector" 301 and then shortly after (depending on the speed of the projectile, which is usually very high and in cases supersonic, and the relatively rigid structure of the projectile, usually in a fraction of a millisecond), the "barrier detector" 302 and then 303 would detect the "significant barrier" encounter. As a result, since the highest detectable acceleration (impact force) level as detected by the "barrier detector" 303 was detected in a very short time (as indicated above usually in a fraction of a millisecond), the "counter" 306 would recognize it as an encounter with essentially a single "significant barrier". However, if the time elapsed between two consequent "significant barrier" detections is relatively large (as compared, for example, to the aforementioned fraction of a millisecond, such as several or even tens of milliseconds), then the "counter" 306 would recognize the encounter as impacts with as many numbers of "significant barriers" with the impact acceleration (impact force) level as indicated by the detecting "barrier detector".

It is appreciated by those skilled in the art that by providing more "barrier detectors", the range and the (step-wise) number of acceleration (impact force) level measurements can be readily increased.

Figure 9:
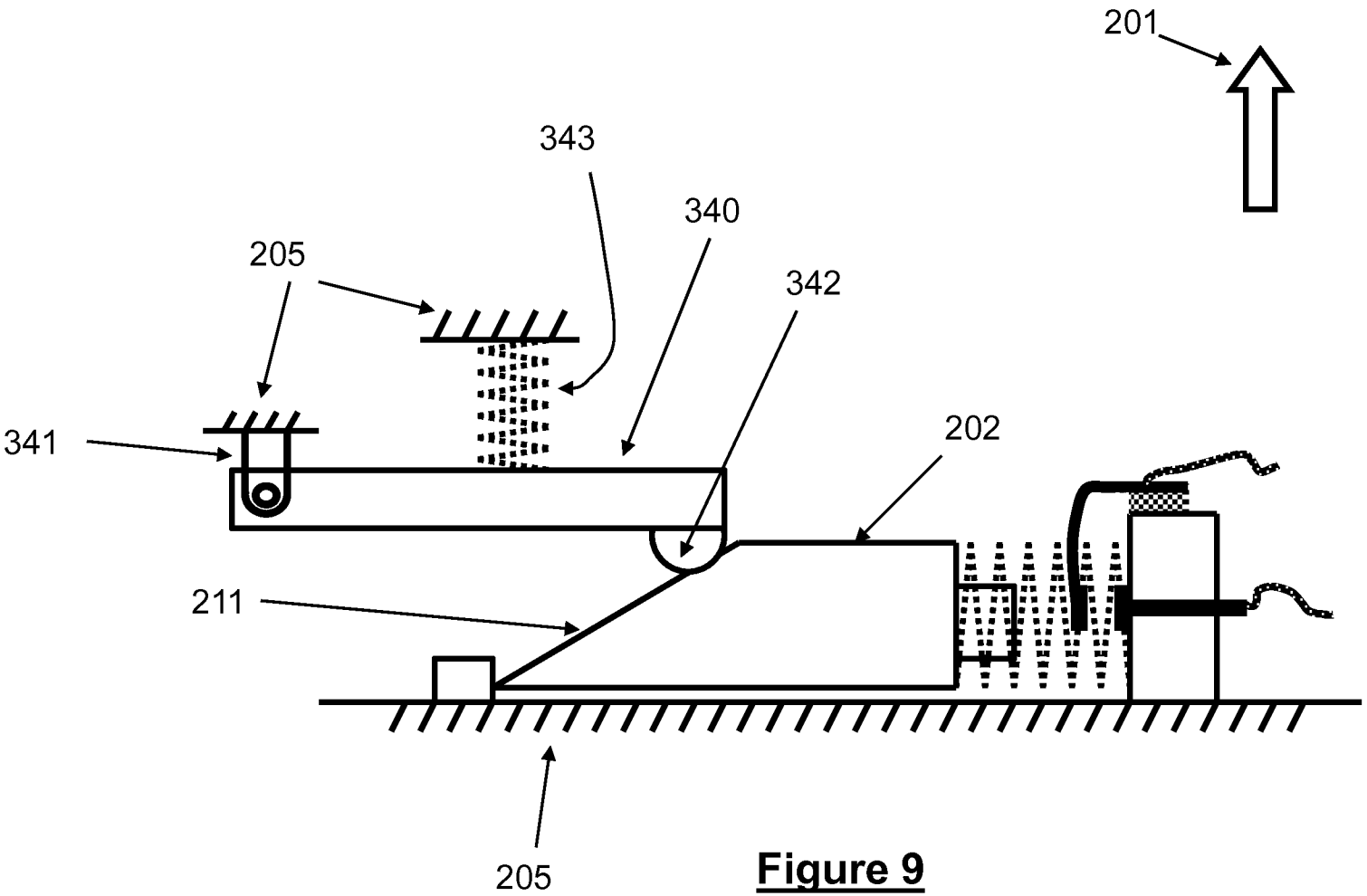
FIG. 9 illustrates the schematic of yet another embodiment of the "significant barrier" encounter event detection device.

It is noted that in the element 203 in the embodiments of FIGS. 1-8, which actuates the element 202 when its mass is subject to acceleration in the direction of the arrow 201 and the element 202 itself are shown to undergo linear (sliding) motions. It is, however, appreciated by those familiar with the art that one or both elements 202 and 203 may also be designed to undergo rotary motion. For example, the element 203 (FIG. 1) may be replaced with the link 340 as shown in the schematic of FIG. 9. The link 340 is attached to the base structure 205 via the rotary joint 341. The link 340 is also provided with (preferably) rounded shaped tip 342, which is in contact with the inclined surface 211 of the sliding element 202. The link 340 is also biased downwards by the compressive spring 343 as shown in FIG. 9 to keep the tip 342 in contact with the inclined surface 211. Then as the resulting device 200 (FIG. 1) using the mechanism shown schematically in FIG. 9 is subjected to acceleration in the direction of the arrow 201 (in this case due to a "significant barrier" encounter), the acceleration acts on the inertial of the link 340, causing the tip 342 to apply a force to the inclined surface 211, thereby causing the device 200 to operate as was previously described for the embodiment of FIG. 1.

It is appreciated by those skilled in the art that the compressively preloaded spring elements 212 and 207 in the embodiment of FIG. 1; and the compressively preloaded spring elements 313, 324, 331 and 343 in the embodiments of FIGS. 6, 7, 8 and 9, respectively, may also be configured to perform the same functions while preloaded in tension (by positioning them to apply the same forces in the same direction while in a tensile loading state).

It is also appreciated by those skilled in the art that the spring elements may be integrated into the structure of the members to which they apply force, for example, the sliding element 203 may be provided with axial flexibility (in the direction of the motion of the element 203), thereby eliminating the need for a separate spring element.

It is also appreciated by those skilled in the art that the sliding joints of the elements 202 and 203 in the embodiment of FIG. 1; the sliding joint of the element 270 in the embodiment of FIG. 4; sliding joints of the members 312, 322 and 330 of the embodiments of FIGS. 6, 7 and 8, respectively; and the rotary joints of the links 333 and 340 of the embodiments of FIGS. 8 and 9, respectively, can be living joints.

It is also appreciated by those skilled in the art that the spring elements used in the different embodiments may be integrated into the structure of the corresponding moving members and be provided with integrated living joints (or their equivalent) to provide the required sliding and/or rotary motions. For example, the rotating link 340 together with its rotary joint 341 may be replaced with a flexible beam (with the tip 342) that is attached to the base structure 205 (for example, at the location of the rotary joint 341). By providing the resulting (cantilever beam—not shown) with the required flexibility that was required of the spring element 343 and the required amount of tip deflection when its inertia is subjected to the acceleration in the direction of the arrow 201, then the cantilever beam would operate as was described for the link 340 as shown in the schematic of FIG. 9.

Figure 10:
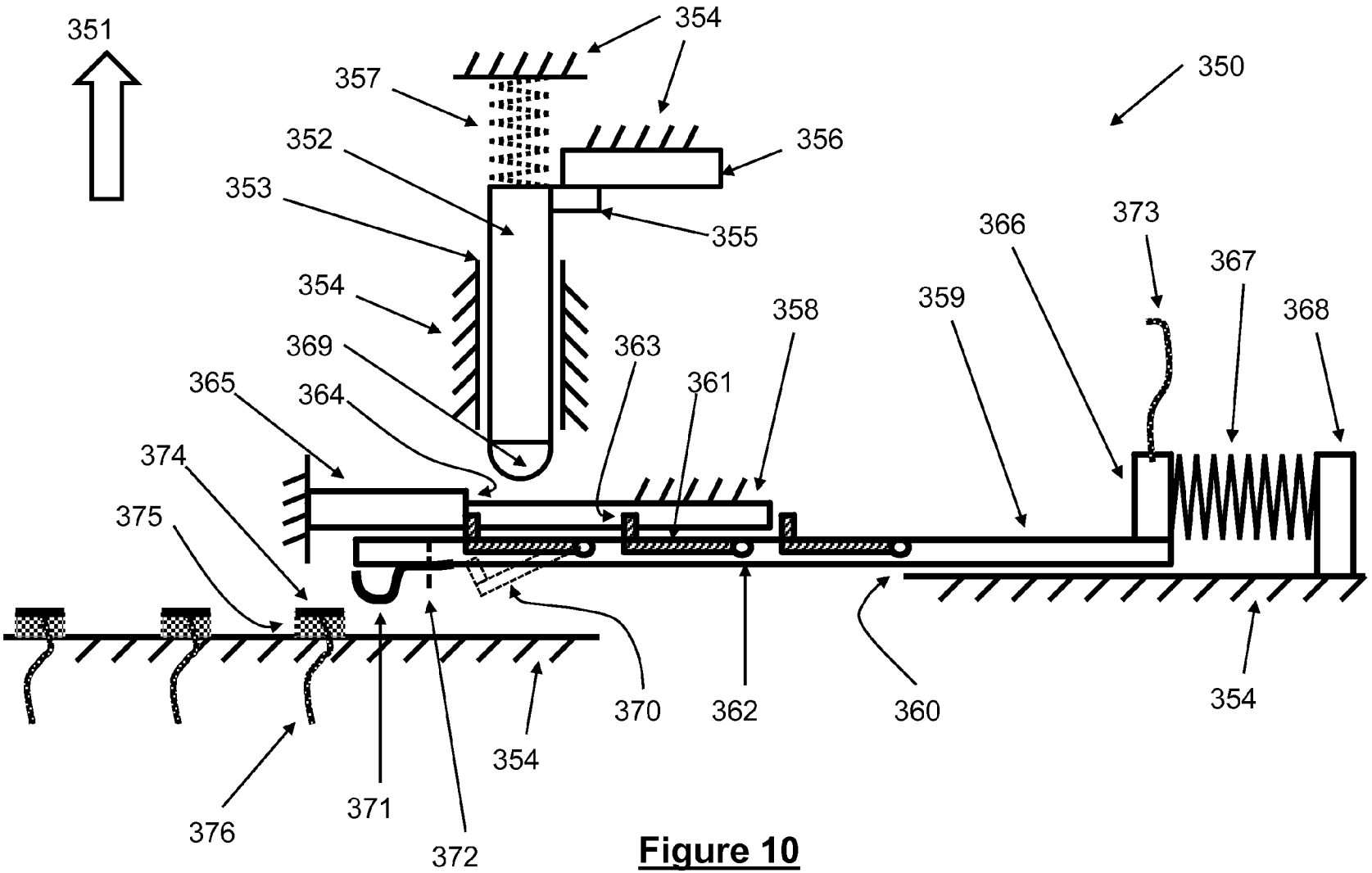
FIG. 10 illustrates the schematic of another embodiment of the "significant barrier" encounter event detection device.

Another embodiment 350 is shown in the schematic of FIG. 10. The device 350 is designed to close an electrical circuit by causing two contacts that keep the circuit open to come into contact when the device is subjected to an acceleration in the direction of the arrow 351 as a result of encountering a "significant barrier", i.e., as a result of impact shock caused by the munitions encountering a "significant barrier". The device 350 consists of the sliding element 352, which is provided with a guide 353, which is provided in the structure 354 of the device 350 or is fixed to the device structure 354. The spring element 357 is attached to the device structure 354 on one end and to the sliding element 352 on the other end and is preloaded in tension. The element 352 is provided with a protrusion 355 which limits its upward motion by coming against the stop 356 provided on the device structure 354. The sliding element 352 is provided with certain amount of mass so that when the device 350 is subjected to an acceleration in the direction of the arrow 351, the resulting dynamic force acting on the sliding element 352 overcomes the tensile force of the spring element 357 and causes it to move downwards as seen in the schematic of FIG. 10 and actuate the device as described below.

The device 350 is also provided with a member 358 which is fixed to the device structure 354, against which the sliding member 359 can slide in a provided guide 360. The sliding member 359 is provided with at least one engagement element 361 (three such elements are shown in the schematic of FIG. 10), which are attached to the sliding member 359 by the rotary joints 362 (which is preferably a living joint). The engagement elements 361 are provided with springs (not shown for the sake of clarity—but which can be provided by the flexibility of living joints used in the construction of the rotary joints 362), which keeps them in the configuration shown in FIG. 10, i.e., essentially in line with the sliding member 359. Each engagement elements 361 is also provided with a side edge 363, which would stop against the surface 364 of the member 365, which is fixed to the device structure 354 in front of the fixed member 358. The sliding member 359 is provided with an end member 366, which is used to bias the sliding member 359 leftwards by the compressively preloaded spring 367, which is positioned between the end member 366 of the sliding member 359 and the member 366, which is fixed to the device structure 354. As a result, the sliding member 359 is at all times biased leftwards, stopping the sliding member 359 by engaging a side edge 363 against the surface 364 of the end member 365.

The device 350 is configured to operate as follows. When the device is subjected to acceleration in the direction of the arrow 351 due to a "significant barrier" encounter, the acceleration acts on the inertia of the sliding element 352, generating a dynamic force that forces the sliding element downwards. The spring element 357 is provided with certain amount of tensile preloading such that until a certain acceleration level is reached the sliding element 352 would not begin to displace downwards. However, when an acceleration level corresponding to the desired "significant barrier" encounter is reached, the dynamic force overcomes the tensile preloading of the spring 357, and the sliding element begins 352 to translate downwards. At some point, the tip 369 will reach the top surface of the underlying engagement element 361, and pushes it downward to the configuration 370 (shown in dashed lines in the schematic of FIG. 10), disengaging the side edge 363 from the surface 364 of the end member 365, thereby allowing the compressively preloaded spring 367 to push the sliding member 359 leftwards. Then when the acceleration due to the "significant barrier" encounter has ended, the sliding element 352 is pulled back against the stop 356 by the tensile spring 357, and the sliding element will slide leftwards until the next side edge 363 comes to a stop against the surface 364 of the end member 365. The process is then repeated every time that the device 350 encounters a "significant barrier".

The device 350 may be used to mechanically (via direct impact) initiate a pyrotechnic material or to close (open) an electrical circuit, which can in turn be used to "count" the number of aforementioned "significant barrier" encounters. Both these options are described below.

In one embodiment, the device 350 is provided with the means to "count" "significant barrier" encounters as shown in the schematic of FIG. 10. In this embodiment, the sliding member 359 is provided with an electrical contact element 371 (which is preferably provided with flexural flexibility), which is attached to the sliding member 359 by a fastener 372, or other means such as welding or soldering or brazing. The sliding member can be constructed with a conductive material such as a metal (which can be stainless steel or brass), to which a conducting wire 373 is attached to form a direct electrical connection to the electrical contact element 371. The device 350 is also provided with appropriately spaced (not drawn to scale in the schematic of FIG. 10 for simplicity) electrical contacts 374, which are attached to the device structure 354 with an intermediate electrically nonconductive element 375. An electrically conductive wire 376 is also attached to the electrical contact element 371. Then as the sliding member 359 is advanced leftwards one step following an encounter with a "significant barrier", the electrical contact element 371 comes into contact with the first electrical contacts 374, thereby closing the electrical circuit between the electrical wires 373 and 376. When the device 350 encounters the next "significant barrier", the sliding member 359 is advanced leftward one more step, and the electrical contact element 371 comes into contact with the next electrical contact 374.

It is noted that in the schematic of FIG. 10 the electrical contact element 371 is shown not to be in contact with an electrical contact 374. It is, however, appreciated by those skilled in the art that the device 350 may alternatively be configured with the two contacts being initially in contact, thereby rendering the circuit (between the wires 373 and 376) closed.

It is also noted that in the schematic of FIG. 10, the embodiment 350 is shown with three sets of electrical contacts 374 (with electrically nonconductive material 375 and electrical wire 376). It is, however, appreciated by those skilled in the art that the embodiment 350 may be constructed with any number of such electrical contacts 374 (with the sliding member 359 also constructed with a corresponding number of engagement element 361), to make the device 350 capable of "countering" the desired number of "significant barrier" encounters.

It is also noted that the embodiment 350 shown in the schematic of FIG. 10 is configured to open and then close an electrical circuit between the wire 373 and the wire 376 of the contacting electrical contact 374. It is appreciated by those skilled in the art that the device 350 can be readily configured to cause the electrical circuit to be closed and then opened during each encounter of the device with a "significant barrier". This is readily accomplished by placing the first electrical contact 374 (together with its electrically nonconductive material 375 and electrical wire 376) as shown in the schematic of FIG. 10 (circuit being initially open), and then positioning the remaining sets of electrical contacts 374 equally spaced thereafter such that during each sliding member 359 advance due to a "significant barrier" encounter, the electrical contact element 371 is first closed and then opened, i.e., that the electrical contact element 371 would first come into contact with an electrical contact 374 and passes it and comes to rest in between two electrical contacts 374.

It is appreciated by those skilled in the art that the device 350 shown schematically in FIG. 10 may be used to electrically initiate a pyrotechnic material (or provide the counting information to the system processor or electronics or other devices to initiate their prescribed actions) as was previously described after a prescribed number of "significant barrier" encounters have been counted. Alternatively, if the prescribed numbers of "significant barriers" have not been encountered with a prescribed period of time, the system (munitions) could initiate an appropriate (predetermined) action such as initiating the pyrotechnic material or disabling the system initiation for safety reasons or the like.

Figure 11:
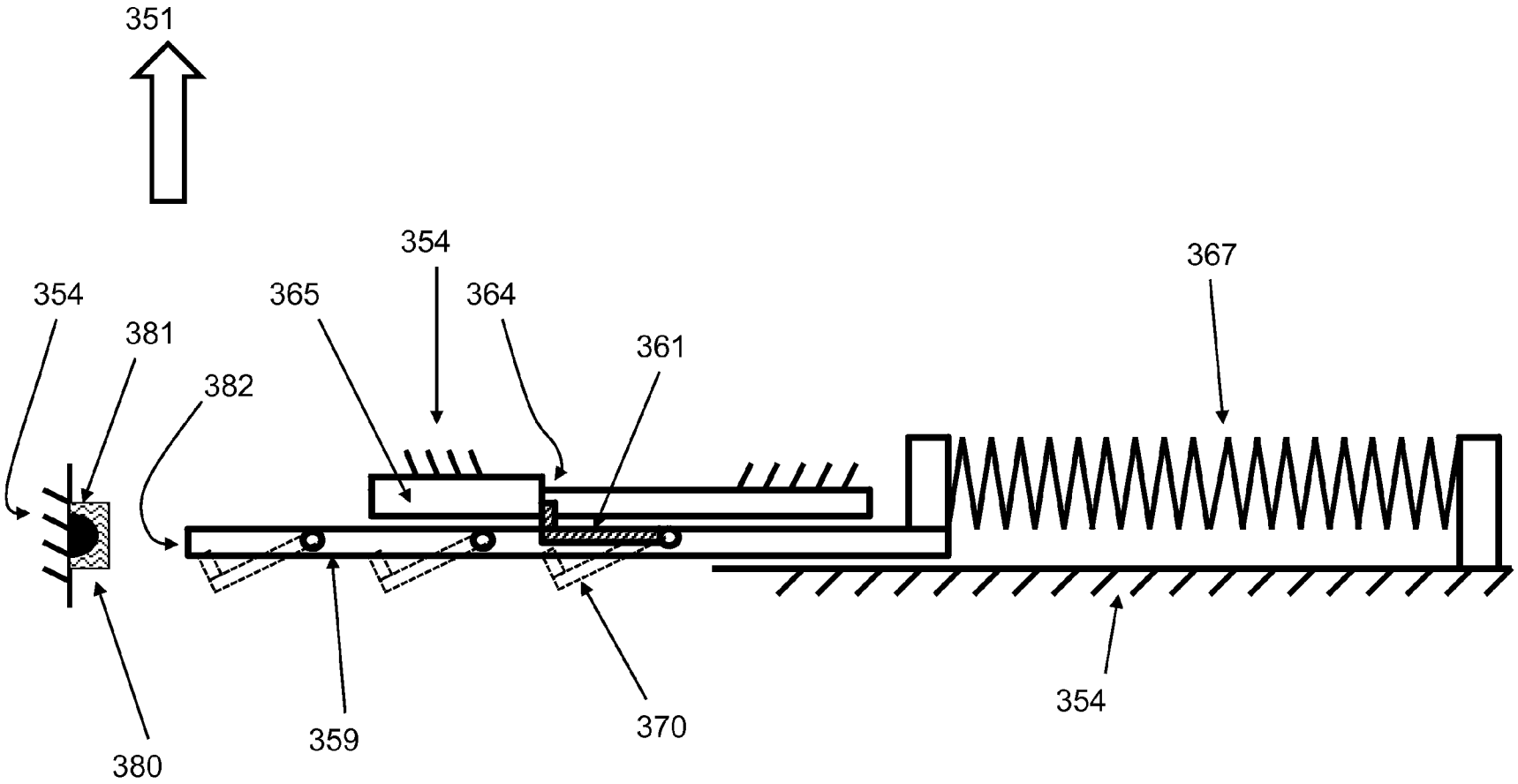
FIG. 11 illustrates the schematic of another embodiment of the present invention for mechanical initiation of a pyrotechnic material after a prescribed number of "significant barriers" have been encountered.

In a modified embodiment 350 shown in the schematic of FIG. 11, the device 350 is intended to ignite pyrotechnic material 380 once a prescribed number of "significant barriers" have been encountered. The pyrotechnic material 380 is attached to the device structure 354 and is provided with a protrusion 381, which would act as an anvil as described below. The modified embodiment 350 will then operate as follows. When the device is subjected to acceleration in the direction of the arrow 351 due to a "significant barrier" encounter, the acceleration acts on the inertia of the sliding element 352 (FIG. 10) as previously described, moving it downwards and disengaging the side edge 363 of the engagement element 361 from the surface 364 of the end member 365, thereby allowing the compressively preloaded spring 367 to push the sliding member 359 leftwards. Then when the acceleration due to the "significant barrier" encounter has ended, the sliding element 352 is pulled back against the stop 356 by the tensile spring 357, and the sliding element will slide leftwards until the next side edge 363 comes to a stop against the surface 364 of the end member 365. The process is then repeated every time that the device 350 encounters a "significant barrier". Then when the last prescribed "significant barrier" is encountered, the last engagement element 361 is released from its engagement with the surface 364 of the end member 365, and frees the sliding member 359 to move leftwards towards the pyrotechnic material 380. At this time the compressively preloaded spring 367 would force the sliding member 359 to be accelerated leftward towards the pyrotechnic material 380, and impact it at relatively high speed. The force of such impact would then pinch the pyrotechnic materials 380 between the surfaces of the protruding element 381 and the end surface 382 (which can also be provided with a similar protruding element—not shown), causing the pyrotechnic material 380 to be ignited.

Figure 12:
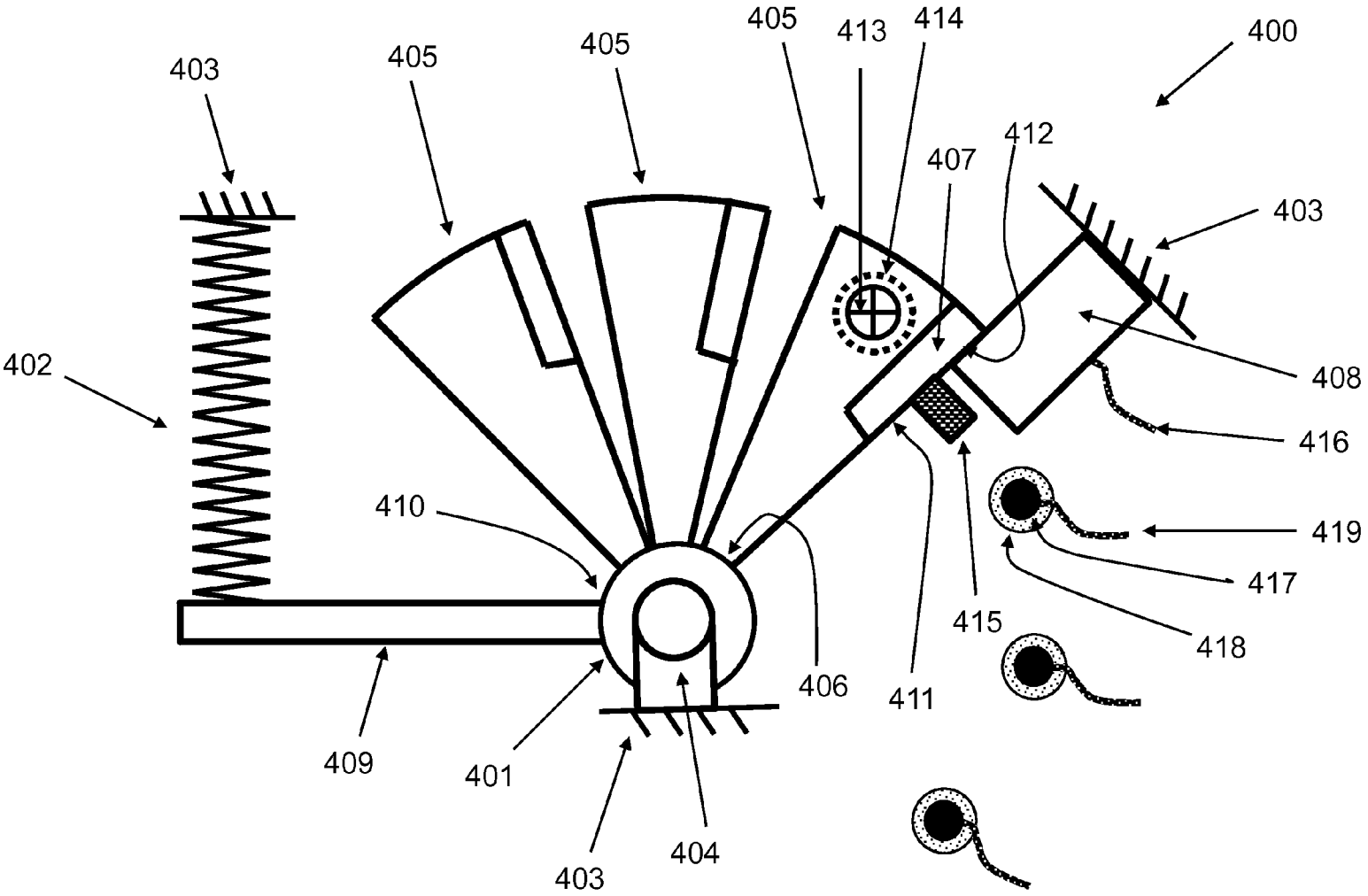
FIG. 12 illustrates the schematic of an alternative embodiment of the "significant barrier" encounter event detection mechanism of FIG. 11.

The mechanism of the embodiments of FIGS. 10 and 11 are designed to achieve stepwise linear motion of the sliding member 359 following each "significant barrier" encounter. It is, however, appreciated by those skilled in the art that the mechanism may also be designed to achieve stepwise rotary motion of a rotary member following each aforementioned encounter with a "significant barrier". Such an embodiment 400 operating with the alternative rotary mechanism is shown in the schematic of FIG. 12. In the schematic of FIG. 12, the top view of the rotary members 401 (replacing the sliding member 359 in the embodiment 350 of FIGS. 10 and 11) and its operating spring 402 (replacing the sliding member 367 in the embodiment 350 of FIGS. 10 and 11) are only shown and the sliding element 352 that reacts to the accelerations due to "significant barrier" encounters as described previously and its related components are not shown for the sake of clarity.

In the embodiment 400, the rotary member 401 is attached to the device 400 structure 403 by the rotary joint 404. At least one engagement member 405 (three such members are shown in the schematic of FIG. 12) are attached at the base 406 to the rotary member 401 as shown in FIG. 12. Each engagement member 405 is provided with an "edge" member 407, which is fixed to the engagement member 405. The device 400 is also provided with a stop member 408, which is fixed to the device structure 403. The stop member 408 has certain thickness (in the direction perpendicular to the plane of FIG. 12), and can be constructed essentially as a relatively short cantilever beam. A lever 409 is also attached to the rotary member 401 at its end 410, and is attached to the spring 402 at its other end. The spring 402 is preloaded in tension. The side 411 of the edge member 407, in normal conditions, is at a level that would engage the side 412 of the stop member 408 when the rotary member 401 is rotated in the clockwise direction by the tension preloaded spring 402.

In an initial configuration, the device 400 can be configured as shown in the schematic of FIG. 12. In this initial configuration, the tensile preloaded spring 402 has rotated the "first" engagement member 405 to bring its side 411 of the edge member 407 to stop against the side 412 of the stop member 408 as shown in the schematic of FIG. 12.

It is noted that a sliding element 352 assembly similar to that of the embodiment 350 of FIG. 10 is positioned above (above the plane of the view of the device 400 assembly shown in FIG. 12, and is intended to operate as previously described for the embodiment 350 of FIG. 10, i.e., to slide downwards due to acceleration in the direction of the arrow 351 due to a "significant barrier" encounter, FIG. 10. In the case of device 400, the sliding element 352 is positioned above the engagement member 405 that has come to a stop against the stop member 408. In the schematic of FIG. 12, the position of the sliding member 352 is shown by the cross marking 413.

The device 400 is configured to operate as follows. When the device 400 is subjected to acceleration in the direction of the arrow 351 (FIG. 10) due to a "significant barrier" encounter, the acceleration acts on the inertia of the sliding element 352, generating a dynamic force that forces the sliding element downwards, overcoming the tensile force of the spring element 357, allowing the sliding element 352 to begin to displace downwards as was described for the embodiment 350 of FIG. 10. The tip 369 (FIG. 10) will then reach the spot 413 on the engagement member 405, and begin to push the engagement member 405 downwards (in the schematic of FIG. 12, the position of the sliding element 352 is shown by the dash lined circle 414). The engagement member 405 is constructed essentially as a cantilever beam that is attached to the rotary member 401 and is provided with enough (flexural) flexibility to undergo downward bending upon the application of the downward force by the tip 369 of the sliding member 352. The flexural flexibility of the engagement member 405 is selected such that with the desired level and duration of the aforementioned acceleration of the device 400 due to an encounter with a "significant barrier", the engagement member 405 is bent downwards enough for the contact between the surfaces 411 and 412 to be lost. As a result, the corresponding edge member 407 and the engagement member 405 are pushed under the stop member, and the tensile preloaded spring 402 will cause the rotary member 401 to rotate in the clockwise direction and move under the stop member 408, until the surface 411 of the edge member 407 of the next engagement member 405 comes into contact with the sliding element 352 (not shown). Then after the "significant barrier" encounter has ended, the rotary member 401 will continue to rotate in the clockwise direction until the surface 411 of the edge member 407 of the next engagement member 405 comes to a stop against the surface 412 of the stop member 408. As a result, the rotary member is advanced "one step" following each one of its encounters with a "significant barrier".

The device 400 may be used to mechanically (via direct impact) initiate a pyrotechnic material or to close (open) an electrical circuit, which can in turn be used to "count" the number of aforementioned "significant barrier" encounters. Both these options are described below.

In one embodiment, the device 400 is provided with the means to "count" "significant barrier" encounters by the closing (opening) of an electrical circuit as shown in the schematic of FIG. 12. In this embodiment, the engagement member 405 is provided with an electrical contact element 415 (which is preferably provided with flexural flexibility), which is attached to the engagement member 405 by a fastener or other means such as welding or soldering or brazing. The engagement member 405 is preferably constructed with a conductive material such as a metal (which can be stainless steel or brass), which can then conduct electricity from the contact element 415 to the device structure 403, and from there to the stop member 408 and the electrically conductive wire 416 (the wire 416 may alternatively be attached to the device structure 403 or the engagement member 405, or other intermediate members). Then as the rotary member 401 advances (rotates) one step due to an encounter with a "significant barrier" as previously described, the contact element 415 comes into contact with the contact element 417, which is attached to the device structure 403 with an intermediate electrically non-conducting element 418. As a result, an electrical circuit is established between the electrical wires 416 and the electrical wire 419, which is attached to the contact element 417. The device 400 is also provided with an appropriate number of similar electrical contacts 417, which are spaced to sequentially engage the contact element 415 as the rotary member 401 advances (rotates) each step due to an encounter with consecutive "significant barriers" (three such electrical contacts are shown in the schematic of FIG. 12).

In the schematic of FIG. 12 the said electrical circuit is closed between the conductive wires 416 and 419, each attached to the indicated members of the device 400. It is, however, appreciated by those skilled in the art that, for example, the wire 416 may be connected to any other intermediate members such as the base structure 403.

It is noted that in the schematic of FIG. 12 the electrical contact element 415 is shown not to be in contact with an electrical contact 417. It is, however, appreciated by those skilled in the art that the device 400 may alternatively be configured with the two contacts being initially in contact, thereby rendering the circuit (between the wires 416 and 419) closed. Alternatively, the contact 415 may be positioned such that it is not initially in contact with the electrical contact 417 as shown in the schematic of FIG. 12. The electrical contacts 417 can then be positioned such that as an engagement member 405 is advanced one step, the contact 415 comes into contact with an electrical contact 417, and then loses contact with the electrical contact 417 and comes to a stop between two electrical contacts 417. As a result, during each engagement member advancement step, the electrical circuit between the wires 416 and 419 is closed and then quickly opened, thereby causing a signal to be provided to the system control circuits indicating an encounter with a "significant barrier".

It is also noted that in the schematic of FIG. 12, the embodiment 400 is shown with three sets of electrical contacts 417 (with electrically nonconductive material 418 and electrical wires 419). It is, however, appreciated by those skilled in the art that the embodiment 400 may be constructed with any number of such electrical contacts 417 (with the rotary member 401 also constructed with a corresponding number of engagement members 405), to make the device 400 capable of "countering" the desired number of "significant barrier" encounters.

In another embodiment, the device 400 is used to mechanically (via direct impact) initiate a pyrotechnic material. In this embodiment shown in the schematic of FIG. 13, an impact pin 420 with a hard tip 421 is attached to the first engagement member 405. The device 400 is also provided with the pyrotechnic material 422, which is attached to the device structure 403 and is provided with a protrusion 423, which would act as an anvil as described below. Then when the last prescribed "significant barriers" is encountered, the last engagement element 405 is released from its engagement with the stop member 408, allowing the tensile preloaded spring 402 to accelerate the impact pin 420 towards and impact the pyrotechnic material 422. As a result, the hard tip 421 will pinch the pyrotechnic materials 422 between the surfaces of the protruding element 423 and the hard tip 421, causing the pyrotechnic material 422 to be ignited.

Figure 13:
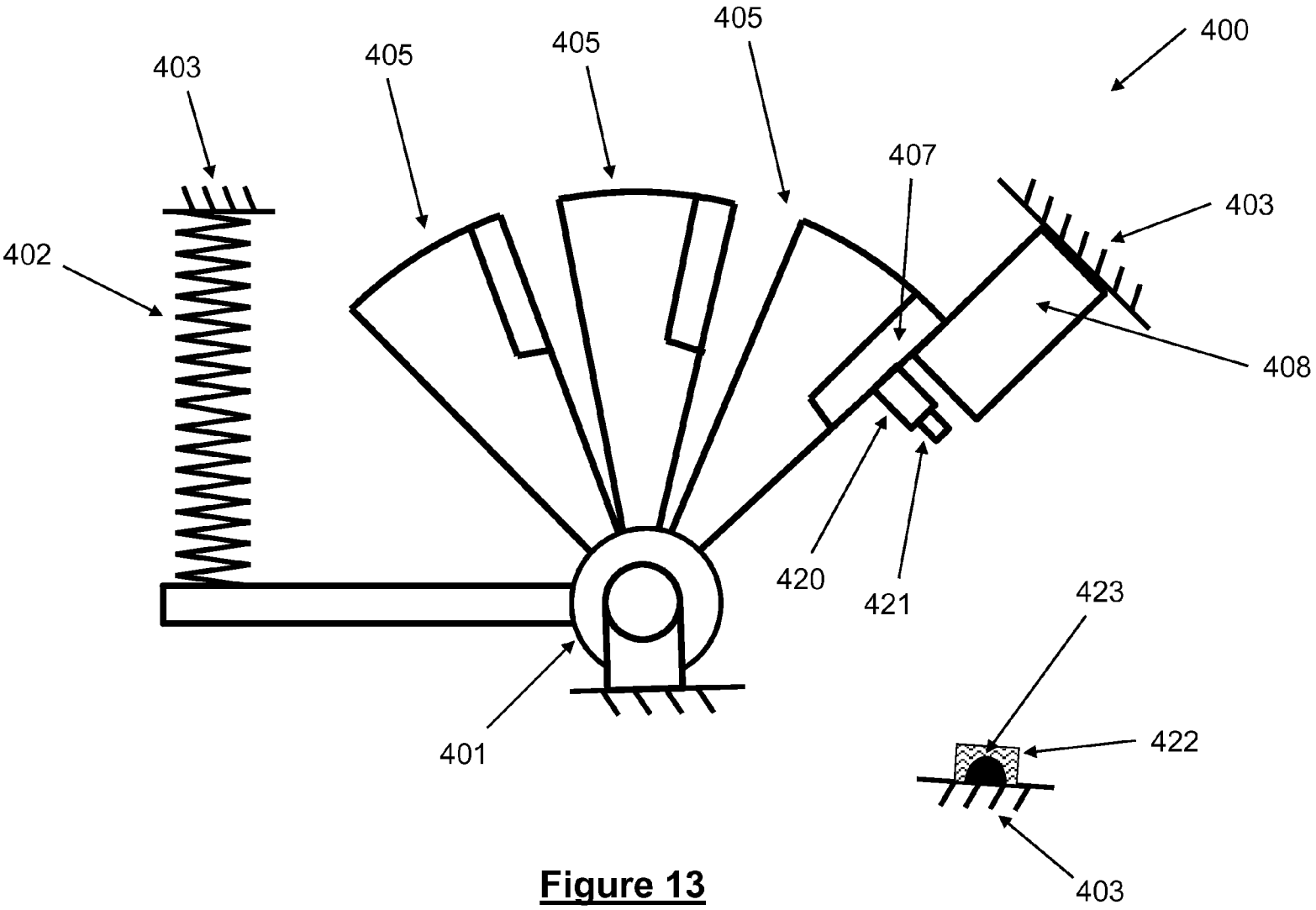
FIG. 13 illustrates the schematic of an alternative embodiment of the "significant barrier" encounter event detection mechanism of FIG. 12 for direct initiation of pyrotechnic charges.

It is noted that in the schematic of FIGS. 12 and 13, a linear helical spring that is preloaded in tension is shown to be used to bias the rotary member 401 in the clockwise direction. It is, however, appreciated by those skilled in the art that a compressively preloaded linear spring or a preloaded torsion spring may be also be employed to provide the same function. In fact, particularly when a limited number of "significant barrier" encounters are intended to be detected, the rotary joint 404 may be constructed as a living joint with appropriate level of elasticity such that by rotating the rotary member 401 in the counterclockwise direction to bring it to its initial pre-target-impact position shown in FIGS. 12 and 13, the living joint is preloaded enough in torsion to eliminate the need for added torsion or other preloaded spring elements.

Figure 14:
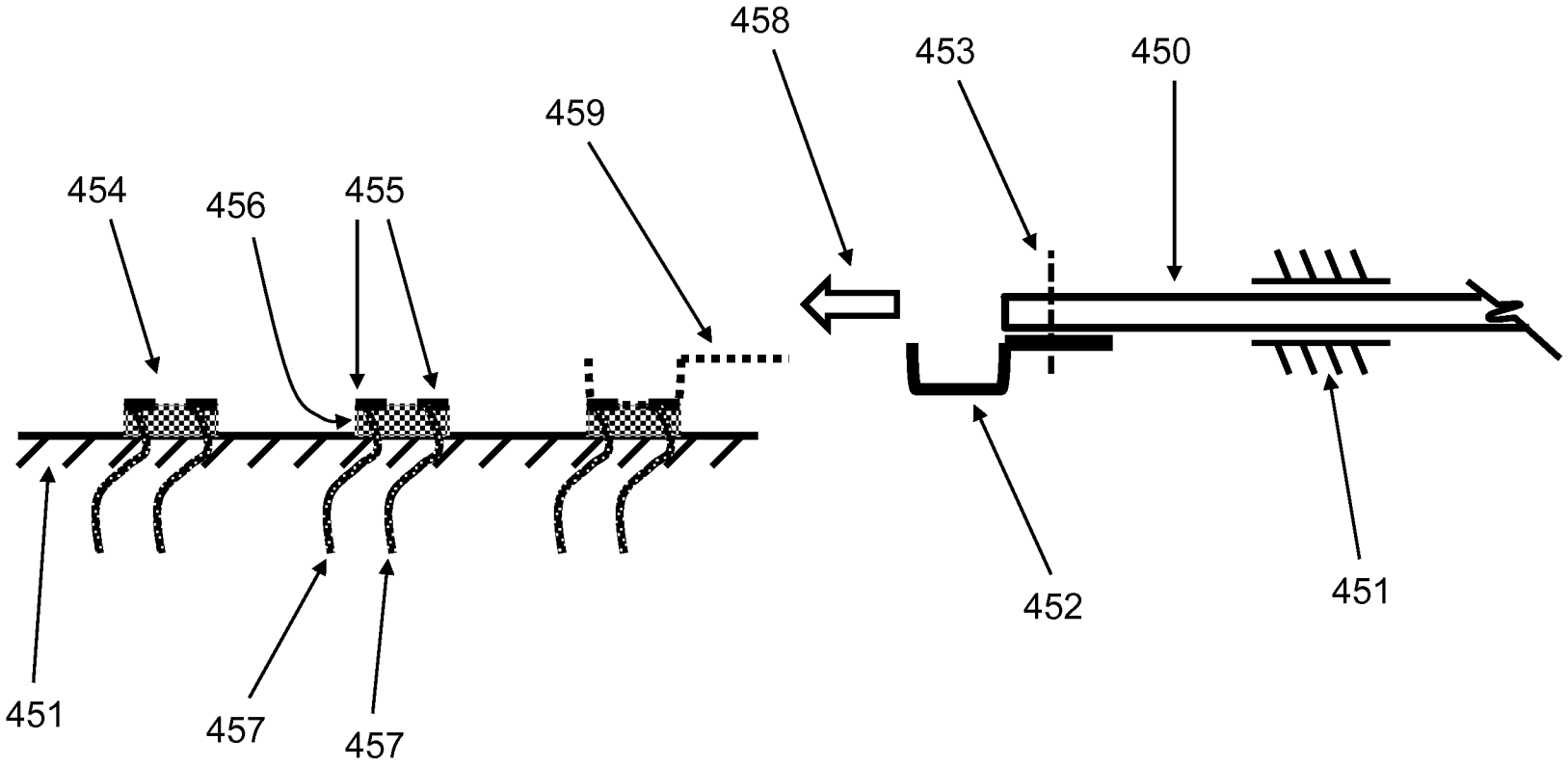
FIG. 14 illustrates an example of a multiple contact opening or closing configuration that can be used in contact opening/closing embodiments of the present invention.

In the embodiments of FIGS. 1-4, 9-10 and 12, a single electrical contact are shown to be closed or opened as a result of a "significant barrier" encounter. It is, however, appreciated by those skilled in the art that many other single or multiple contact configurations may also be implemented to achieve the desired multiple circuit opening and/or closing actions. As an example, consider the configuration shown in FIG. 14, showing the electrical contacts and operating members of the embodiment of FIG. 10. In FIG. 14, the frontal portion of the sliding member 450 (member 359 in FIG. 10) is shown, which slides relative to the base structure 451. The contact element 452 (contact 371 in FIG. 10) is attached to the tip of the sliding member 450 as shown in FIG. 14, for example with a fastener 453 or using any other method such as welding or brazing. The contact units 454 consisting of at least two electrical contacts 455 (in the schematic of FIG. 14 only two such contacts are shown), which are fixed to the device structure 451 with intermediate electrically non-conductive elements 456, and to each of which an electrically conductive wire 457 is attached. Then as the device encounters a "significant barrier", the sliding member 450 is advanced one step as was described for the embodiment of FIG. 10, moving the sliding member 450 in the direction of the arrow 458 and placing the contact element 452 in contact with the two contacts 455 (the contact element 452 in its latter position is shown by dotted and is indicated by the numeral 459 in FIG. 14). As a result, the circuit between the two contact wires 457 is closed.

It is appreciated by those skilled in the art that many different contact opening and closing configurations one or more contact 455 is possible. For example, as was previously described, the contact element 452 may be positioned initially in contact with the two contacts 455 (shown in dotted lines 459) and as a result of the device encountering a "significant barrier", the contact element 452 is moved to the next contact assembly 454. Alternatively, the contact element 452 may be positioned initially as shown in FIG. 14 and as a result of the device encountering a "significant barrier", the contact element 452 is moved forward in the direction of the arrow 458, comes into contact with the two contacts 455, thereby closing the circuit between the two wires 457, and pass the contact assembly 454 and stop between two such contact assembly 454. As a result, as the device encounters a "significant barrier", the circuit between the two wires 457 is closed for a very short time, thereby allowing the system control to register such an encounter with a "significant barrier".

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A mechanism for detecting a number of events having an acceleration profile greater than a predetermined threshold, the mechanism comprising:

a first mass member movable in response to the acceleration profile being greater than the predetermined threshold, a second mass member movable in response to engagement of a portion of the first mass member with a corresponding surface of the second mass member; and a counter for one of mechanically or electrically counting a number of events in which the acceleration profile is greater than the predetermined threshold, said counter comprising first and second contacts and a portion of the second mass member configured to engage one of the first and second contacts to one of an open electrical contact or a closed electrical contact between the first and second contacts;

wherein when the acceleration profile is greater than the predetermined threshold, the portion of the first mass member applies a force against the surface of the second mass member to move the second mass member, the movement of the second mass member being input to the counting mechanism.

2. The mechanism of claim 1, further comprising a first biasing element for biasing the portion of the first mass member into engagement with the surface of the second mass.

3. The mechanism of claim 1, further comprising a second biasing member for biasing the second mass member such that the surface of the second mass member is in engagement with the portion of the first mass member.

4. The mechanism of claim 1, wherein the first mass member is movable in translation.

5. The mechanism of claim 1, wherein the portion of the first mass member is a rounded tip.

6. The mechanism of claim 1, wherein the second mass member is movable in translation.

7. The mechanism of claim 1, wherein the surface of the second mass member is a tapered surface.

8. The mechanism of claim 1, wherein the counter further comprises a controller configured to:

count the number of times the first and second contacts are opened or closed; and output a control signal based on the number of times the first and second contacts are opened or closed.

9. The mechanism of claim 8, wherein the control signal either initiates fuzing if the number of times the first and second contacts are opened or closed is greater than a predetermined number or initiates disarming fuzing if the number of times the first and second contacts are opened or closed is less than the predetermined number.

* * * * *